US006527377B1

(12) United States Patent
Ikegame et al.

(10) Patent No.: US 6,527,377 B1
(45) Date of Patent: Mar. 4, 2003

(54) LIQUID DISCHARGE HEAD AND PRODUCING METHOD THEREFOR

(75) Inventors: Ken Ikegame, Tokyo (JP); Yoshiaki Suzuki, Yokohama (JP); Toshio Kashino, Fujisawa (JP); Shuji Koyama, Kawasaki (JP); Masashi Miyagawa, Yokohama (JP); Junji Tatsumi, Kawasaki (JP); Hiroaki Mihara, Musashino (JP); Miki Ito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/483,954

(22) Filed: Jan. 18, 2000

(30) Foreign Application Priority Data

| | | |
|---|---|---|
| Jan. 18, 1999 | (JP) | 11-009440 |
| Jan. 29, 1999 | (JP) | 11-021627 |
| Feb. 10, 1999 | (JP) | 11-033267 |
| Feb. 10, 1999 | (JP) | 11-033268 |
| Jul. 2, 1999 | (JP) | 11-189622 |

(51) Int. Cl.[7] ..... B41J 2/05
(52) U.S. Cl. ..... 347/56; 347/61
(58) Field of Search ..... 347/20, 44, 47, 347/54, 56–67

(56) References Cited

U.S. PATENT DOCUMENTS

| | | | | |
|---|---|---|---|---|
| 4,994,825 A | | 2/1991 | Saito et al. | 346/140 R |
| 5,057,853 A | | 10/1991 | Fisher | 346/140 R |
| 5,059,973 A | | 10/1991 | Watanabe | 346/1.1 |
| 5,160,577 A | | 11/1992 | Deshpande | 156/644 |
| 5,371,528 A | | 12/1994 | Izumida et al. | 347/87 |
| 5,478,606 A | | 12/1995 | Ohkuma et al. | 427/555 |
| 5,494,698 A | | 2/1996 | White et al. | 427/295 |
| 5,604,521 A | * | 2/1997 | Merkel et al. | 347/47 |
| 5,748,213 A | | 5/1998 | Karita et al. | 347/63 |
| 5,808,641 A | | 9/1998 | Miyagawa et al. | 347/65 |
| 5,963,232 A | | 10/1999 | Kasamoto et al. | 347/58 |
| 6,155,677 A | | 12/2000 | Kitani et al. | 347/65 |
| 6,180,018 B1 | | 1/2001 | Miyagawa et al. | 216/27 |
| 6,220,688 B1 | | 4/2001 | Ishimatsu et al. | 347/20 |

FOREIGN PATENT DOCUMENTS

| | | |
|---|---|---|
| EP | 0370776 A2 | 5/1990 |
| EP | 04353456 | 12/1992 |
| EP | 0631869 A1 | 1/1995 |
| JP | 2-78560 | 3/1990 |
| JP | 2-187342 | 7/1990 |
| JP | 5-330061 | 12/1993 |
| WO | WO98/42514 | 1/1998 |

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

A liquid discharge head having plural liquid paths and plural discharge openings is formed by joining an adhesion face of an orifice plate with an adhesion face of a head main body. The liquid paths are provided in the head main body, and the adhesion face of the head main body has apertures of the liquid paths. The adhesion face of the orifice plate has recessed portions and protruding portions. The protruding portions have a shape corresponding to the cross-sectional shape of the liquid paths, and the discharge openings are provided in the protruding portions. The protruding portions or parts thereof fit into the liquid paths, and are inserted into the liquid paths for joining the adhesion face of the orifice plate with the adhesion face of the head main body.

4 Claims, 31 Drawing Sheets

LIQUID DISCHARGE HEAD AND PRODUCING METHOD THEREFOR

BACKGROUND OF THE INVENTION

1. Field of the Invention

The present invention relates to a liquid discharge head for discharging liquid and forming a flying liquid droplet thereby effecting recording, and formation of discharge opening (also called orifice) for discharging liquid. The present invention is applicable to an apparatus such as a printer for recording on a recording medium such as paper, yarn, fiber, fabrics, leather, metal, plastics, glass, timber, ceramics etc., a copying apparatus, a facsimile apparatus having communicating function, or a word processor having a printer unit, or an industrial recording apparatus combined in complex manner with various processing apparatus.

In the present invention, "recording" means not only providing the recording medium with a meaningful image such as a character or graphics but also providing with a meaningless image such as a pattern.

2. Related Background Art

The ink jet recording apparatus, effecting recording by discharging recording liquid (ink) from the orifice of the liquid discharge head, is already known to be excellent in low noise and high speed recording.

Such ink jet recording method has been proposed in various systems, some of which are already commercialized and some are still under development for commercialization.

The liquid discharge head for such recording method is for example composed, as shown in FIGS. 6 and 7, of an orifice plate 40 having an orifice for discharging the liquid, a ceiling plate 400 for forming a liquid path 401 communicating with the orifice, and a substrate 100 constituting a part of the liquid path and provided with an energy generating element 101 (hereinafter called heater) for generating energy for ink discharge.

The orifice plate 40 is provided with a small orifice 41 for discharging ink, and the orifice 41 constitutes an important element governing the discharging performance of the liquid discharge head. The orifice plate 41 of the liquid discharge head 40 is required to be satisfactorily workable in order to form the small orifice, and to have satisfactory ink resistance as it is in direct contact with the ink.

For meeting these requirements, there has conventionally been employed a metal plate such as of SUS, Ni, Cr or Al, or a resinous film material easily and inexpensively available in a desired thickness such as of polyimide, polysulfone, polyethersulfone, polyphenylene oxide, polyphenylene sulfide or polypropylene.

On the other hand, with the recent progress in the recording technology, there has been required recording with a higher speed and a higher definition, and, for this reason, the orifices 41 are being formed with a smaller size (orifice diameter) and with a higher density. As a result, there have been devised various methods for forming the orifice 41, and, in case of using the resinous film, the orifice is formed with a laser beam which is suitable for fine working. Also in case of employing a metal plate, the orifice 41 is formed for example by electroforming.

However, it is extremely difficult to adjoin the orifice plate 40 having a small orifice and the corresponding liquid path 401 without a gap to the (neighboring orifice 41.

For this reason, there has been employed a method of adhering the resinous film for forming the orifice to the main body of the head and then forming the orifice with the laser beam as disclosed in the Japanese Patent Application Laid-open No. 2-187342, or of employing a dry film or the like for the orifice plate, pressing the dry film in a softened state by heating into the adhering face of the main body of the head thereby pressing the softened orifice plate into the liquid path and forming the orifice by a photolithographic process or with a laser beam, as disclosed in the Japanese Patent Application Laid-open No. 2-204048.

The orifice of the liquid discharge head preferably has so-called tapered shape in which the diameter gradually decreases from the liquid path side to the discharge opening side, but, if the orifice plate after formation of the orifice of such tapered shape is adhered by applying adhesive resin for example by transfer method, such adhesive resin may intrude into the orifice to very the tapered shape thereof, thereby resulting in a drawback such as fluctuation in the direction of discharge. Also a bubble inclusion caused by defective contact induces insufficient adhesion in the partition to the neighboring orifice, thus resulting in defective liquid discharge.

Consequently, there is also adopted a method of forming a step in the vicinity of the orifice, in order that the adhesive resin does not intrude into the liquid path and the orifice, as disclosed in the Japanese Patent Application Laid-open No. 5-330061.

Furthermore, in case of adhering the orifice plate having the orifice to the adhering face of the main body of the head, the positional aberration may take place by the contraction of the adhesive resin at the hardening thereof. Therefore, as disclosed in the Japanese Patent Application Laid-open No. 2-78560, there is also adopted a method of forming surface irregularities on the adhering face of the orifice plate, in order to prevent the influence caused by the contraction of the adhesive resin at the hardening.

Also the main body of the liquid discharge head, to be adhered to the above-mentioned orifice plate, can be prepared for example by the following-method. On a silicon substrate, discharge energy generating elements are formed, and photosensitive resin for forming the liquid path walls is laminated thereon. Thereafter the photosensitive resin is patterned to form the desired liquid path walls. After the formation of the liquid path walls, a ceiling plate, composed for example of a glass plate, is laminated thereon to complete the liquid paths. Then the obtained laminated body is cut for example with a diamond blade to separate the liquid paths and to adjust the length thereof. Then the orifice plate is adhered for example an adhesive material in such a manner that the orifices communicate with the liquid paths to obtain the desired liquid discharge head. FIG. 39 is a perspective view showing a conventional example of the liquid discharge head and FIG. 40 is a plan view thereof.

In the liquid discharge head shown in FIGS. 39 and 40, liquid path walls 1301 and electrothermal converting elements 1303 serving as the discharge energy generating elements are formed on a silicon substrate 1309, and a ceiling plate 1310 composed for example of a silicon substrate is adhered thereon. The laminated body is cut off with a diamond blade for the purpose of adjusting the position of the liquid paths 1302, and an orifice plate 1307 is adhered with adhesive 1306 for example epoxy resin.

Also in such liquid discharge head, there has been a drawback that the adhesive employed for adhering the orifice plate enter and clog the liquid path. For this reason, there is adopted the method of forming a step in the vicinity of the orifice thereby preventing intrusion of the adhesive into the liquid and the orifice as disclosed in the Japanese Patent Application Laid-open No. 5-330061.

However, the above-described conventional configurations have been associated with the following drawbacks.

In pressing the softened resin into the liquid path at the adhering operation of the orifice plate to the main body of the head, the intruding amount of resin into the liquid path is difficult to control. As the orifices become smaller in diameter and higher in density, the resin intruding into the liquid path significantly influences the discharge performance, resulting in fluctuations of the discharge amount among the nozzles.

Also, with an increase in the density of the orifices and With the recovery operation of the orifice face surface, the distance between the orifices becomes shorter and, if the step structure is formed in the vicinity of the orifices in order to prevent intrusion of the adhesive resin therein, the adhesive strength between the orifices is lowered thereby deteriorating the durability of the liquid discharge head.

Also, with an increase in the density of the orifices, with the use of various inks and with the recovery operation of the orifice face, the adhesive strength between the orifice plate and the main body of the head unless the grooved portion is adhered, thereby deteriorating the durability of the liquid discharge head.

Also in case the resin film is employed for the orifice plate, the laser beam is advantageous for fine working such as orifice formation. However, if the laser working is executed after the orifice plate is adhered, dust such as carbon powder generated by the laser ablation enters the nozzles, thereby resulting in clogging of the orifice or solid deposition on the heater, leading to the defective liquid discharge.

Also in the conventional configuration where the length of the liquid path is adjusted by cutting the adhesion face, to the orifice plate, of the main body of the head, there may result intrusion of cut power and dusts into the liquid path and chipping or cracking of the cut face. Also if the step structure is formed in the vicinity of the orifice, the adhesion strength between the orifices is lowered thereby deteriorating the durability of the liquid discharge head.

SUMMARY OF THE INVENTION

In consideration of the foregoing, an object of the present invention is to provide a liquid discharge head and a producing method therefor, capable of resolving the aforementioned drawbacks in the conventional configurations, preventing the intrusion of the adhesive material into the orifice and the trapping of bubble in the vicinity of the orifice, improving the adhesion strength between the orifice plate and the main body of the head, and preventing the intrusion of dusts, such as carbon powder generated by laser ablation, into the liquid path.

Another object of the present invention is to provide a liquid discharge head and a producing method therefor, capable, in adjusting the length of the liquid path by cutting the adhesion face of the head main body with the orifice plate, of preventing intrusion of dusts and chipping of the cut face at the cutting operation, thereby ensuring a high process yield and improved print quality.

The above-mentioned objects can be attained, according to the present invention, by a liquid discharge head including:

an orifice plate having plural discharge openings for discharging liquid droplets, and a head main body provided with plural liquid paths for respectively communicating with the plural discharge openings, a liquid chamber for liquid supply to the plural liquid paths, a supply aperture for liquid supply to the liquid chamber, and plural energy generating elements provided corresponding to the plural liquid paths and adapted to generate energy for discharging the liquid droplet, and formed by adjoining the orifice plate with an adhesion face of the head main body on which the apertures of the liquid paths for communicating with the discharge openings of the orifice plate;

wherein the orifice plate comprises a recessed portion and a protruding portion on the adhesion face with the head main body, and the protruding portion has a shape corresponding to the cross-sectional shape of the liquid path and is provided the discharge opening therein, and the protruding portion or a part thereof is made to enter and to fit with the liquid path of the head main body and the adhesion face of said orifice plate is adjoined with the adhesion face of the head main body.

According to the present invention there is also provided a method for producing a liquid discharge head formed by adjoining an orifice plate having plural discharge openings for discharging liquid droplets, and an adhesion face of a head main body provided with plural liquid paths for respectively communicating with the plural discharge openings, the method comprising steps of:

forming, on an adhesion face of the orifice plate with the head main body, a recess portion and a protruding portion of a shape matching the cross-sectional shape of the liquid path; and inserting and fitting the protruding portion of the orifice plate or a part thereof into the liquid path of the head main body, and adjoining the orifice plate with the head main body thereby forming the liquid discharge head.

BRIEF DESCRIPTION OF THE DRAWINGS

FIGS. 3A-1, 3A-2, 3B-1, 3B-2, 3C-1, 3C-2, 3D-1 and 3D-2 are schematic cross-sectional views showing an example of steps for forming the orifice plate in a first embodiment of the present invention;

FIGS. 4A-1, 4A-2, 4B-1, 4B-2, 4C-1, 4C-2, 4D-1, 4D-2, 4E-1 and 4E-2 are schematic cross-sectional views showing an example of steps for forming the orifice plate in a second embodiment of the present invention;

FIGS. 5A-1, 5A-2, 5B-1, 5B-2, 5C-1 and 5C-2 are schematic cross-sectional views showing an example of steps for forming the orifice plate in a third embodiment of the present invention;

FIGS. 8A-1, 8A-2, 8B-1, 8B-2, 8C-1 and 8C-2 are schematic cross-sectional views showing an example of steps for forming the orifice plate of the present invention;

FIGS. 23A-1, 23A-2, 23B-1, 23B-2, 23C-1, and 23C-2 are schematic views showing steps for forming the orfice plate in a ninth embodiment of the present invention;

FIGS. 26A-1, 26A-2, 26B-1, 26B-2, 26C-1 and 26C-2 are schematic views showing an example of steps for forming the orifice plate in a tenth embodiment of the present invention;

FIGS. 28A-1, 28A-2, 28B-1, 28B-2, 28C-1 and 28C-2 are schematic views showing steps for forming the orifice plate of the present invention;

FIGS. 29A-1, 29A-2, 29B-1, 29B-2, 29C-1 and 29C-2 are schematic views showing an example of steps for forming the orifice plate in an eleventh embodiment of the present invention;

FIGS. 34A-1, 34A-2, 34B-1, 34B-2, 34C-1, 34C-2, 34D-1 and 34D-2 are views showing steps of forming the orifice plate shown in FIGS. 30 and 31;

For ease of reference hereinbelow, drawings labeled such as FIGS. 3A-1 and 3A-2, FIGS. 3B-1 and 3B-2, etc. are referred to collectively as FIG. 3A, FIG. 3B, etc.

DESCRIPTION OF THE PREFERRED EMBODIMENTS

[First Embodiment]

According to the present invention, a protruding portion is provided around the orifice, extending in the direction of the liquid path and having a cross section matching that of the liquid path, and such protruding portion or a part thereof is made to enter the liquid path to prevent the flow of the adhesive resin into the orifice portion. Also the adhesion face of the orifice plate, to be adhered to the main body of the head, is formed as a recess to prevent the flow of the adhesive resin into the liquid path and the inclusion of bubbles. Furthermore, the adhesive resin is made to enter the above-mentioned groove or a part thereof thereby improving the adhesion force between the orifice plate and the main body of the head.

Also, as the orifice formation can be executed prior to the adhesion to the main body of the head, there can be prevented intrusion of dusts, generated by laser ablation etc., into the liquid path. Furthermore, the present invention can drastically reduce the positional aberration between the liquid path and the orifice, resulting from the difference in the thermal expansion ratio when the orifice plate and the main body of the head are heated to a high temperature.

Furthermore, according to the present invention, the communication aperture of the liquid path, to communicate with the discharge opening port of the orifice plate, is formed by at first cutting the adhesion face of the main body of the head for adhesion with the orifice plate in consideration of the distance to the liquid path, and then forming such communication aperture to be adhered to the orifice plate, thereby dust intrusion or chipping of the communication aperture at the cutting operation.

Figure 1:
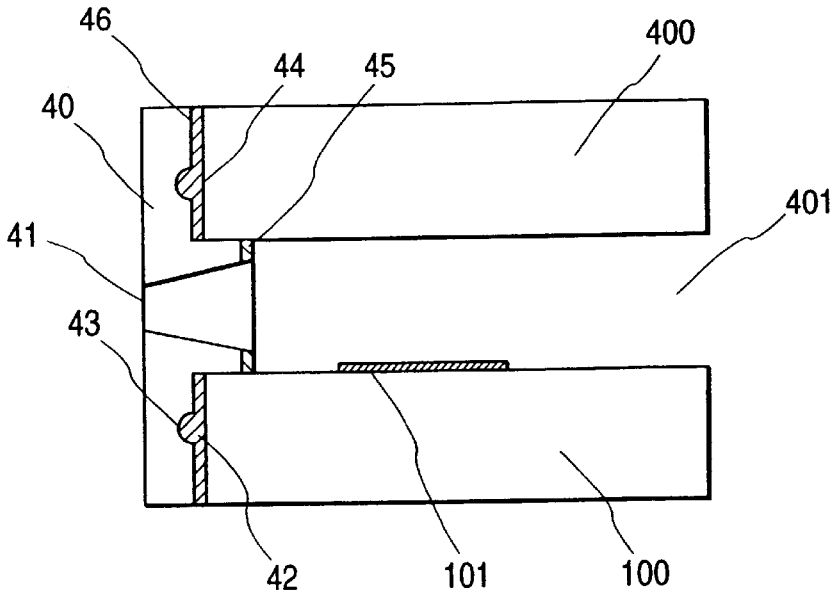
FIG. 1 is a schematic cross-sectional view showing an example of the liquid discharge head embodying the present invention.

In the following there will be schematically explained the configuration of the liquid discharge head of the present invention. FIG. 1 is a schematic cross-sectional view of the liquid discharge head constituting a first embodiment of the present invention, and FIG. 2 is a schematic perspective view thereof.

Figure 2:
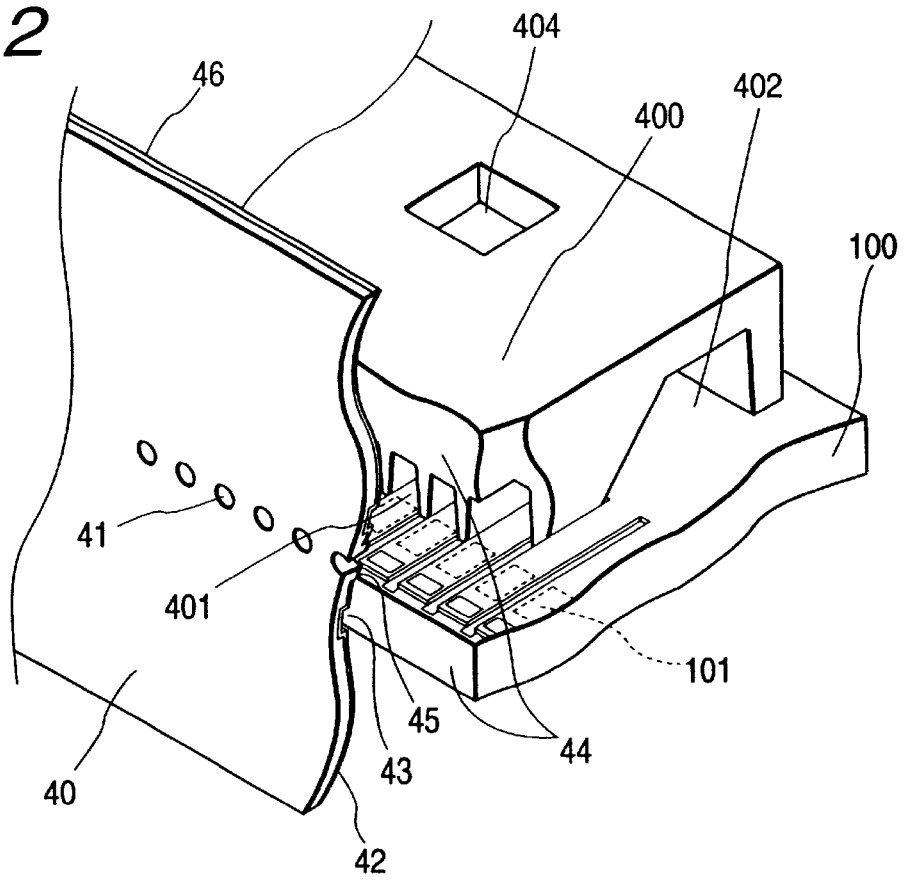
FIG. 2 is a schematic perspective view showing an example of the liquid discharge head embodying the present invention.
Figures 1, 3A:
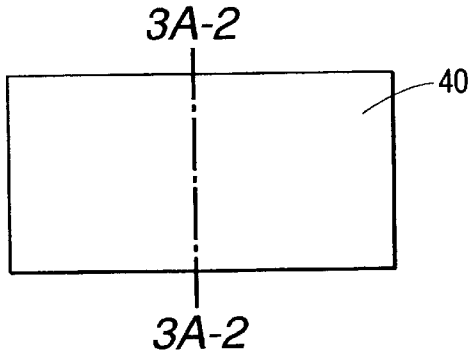
Figures 2, 3A:
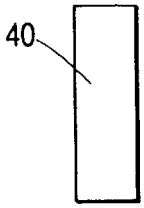

The liquid discharge head shown in FIGS. 1 and 2 is provided with a head main body (not shown) formed by adhering a ceiling plate 400 integrally having a liquid path 401 and a liquid chamber 402, and a substrate (hereinafter called heater board) 100 bearing an energy generating element (hereinafter called heater) 100 for generating discharge energy and Al wirings for supplying the element with an electrical signal, both formed by the film forming technology on a silicon substrate, and an orifice plate 40 to be explained later is adhered as illustrated to an aperture face (hereinafter called adhesion face for the head main body) 44 formed by the above-mentioned adhesion and having an aperture of the liquid path 401 for each unit. The orifice plate 401 is preferably composed of a metal film such as of stainless steel or Ni, or of a plastic film of satisfactory ink resistance such as of polyimide, polysulfone, polyethersulfone, polyphenylene oxide, polyphenylene sulfide or polypropylene.

The orifice plate 40 is provided with a protruding portion 45 matching the Cross section of the liquid path in the direction of arrangement of the liquid paths, and such protruding portion 45 is fitted in the liquid path 401. In such configuration, the protruding portion 45 limits the positional aberration between the orifice and the liquid path, generated in the setting step of the adhesive material or resulting from the temperature change when the heater is activated.

In the present embodiment, the orifice plate was composed of a PSF film of a thickness of 50 $\mu$m.

Also in the present embodiment, for adhering the orifice plate and the main body of the head, there was employed epoxy adhesive resin which is shifted to the B-stage with completed shrinkage under UV irradiation while maintaining the tackiness and is hardened by additional UV irradiation or heating. This adhesive material can also achieve adhesion by heating and pressing only.

In the following the first embodiment of the present invention will be explained with reference to FIGS. 3A to 3D.

Figure 9:
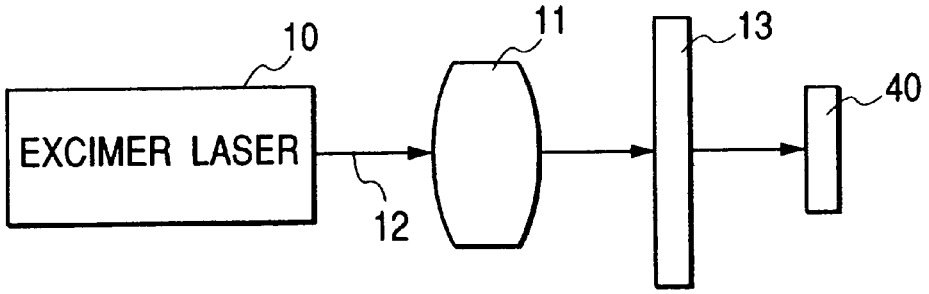
FIG. 9 is a schematic view of an apparatus embodying the present invention.

The orifice plate 40 was worked with the laser light of a KrF laser with a wavelength of 248 nm, and the recess, groove and orifice were formed by an apparatus shown in FIG. 9, in which provided are an excimer laser 10, a lens 11 for condensing the laser beam 12 emitted from the excimer laser 10, a mask 13 positioned between the excimer laser 10 and the orifice plate 40, and an orifice plate 40 on which the recess, groove and orifice are to be formed.

In the following there will be explained steps for forming the liquid discharge head of the present embodiment.

Figures 1, 3B:
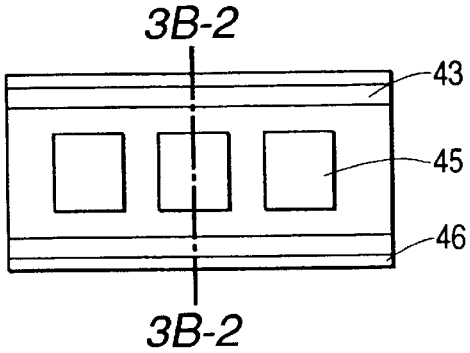
Figures 2, 3B:
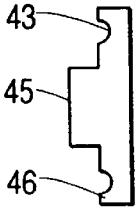

At first a recess 46 was formed on the orifice plate 40 with a depth of 10 $\mu$m in such a manner that plural protruding portions 45 are arranged linearly with a pitch of 600 dpi and with a size of 30×30 $\mu$m, and grooves 43 were formed with a width of 20 $\mu$m and a depth of 20 $\mu$m from the bottom of the recess 46, at a position separated by 30 $\mu$m from the protruding portions 45, thereby forming the adhesion face, having the recess 46 and the grooves 43, for adhesion with the main body of the head (FIG. 3B).

Figures 1, 3C:
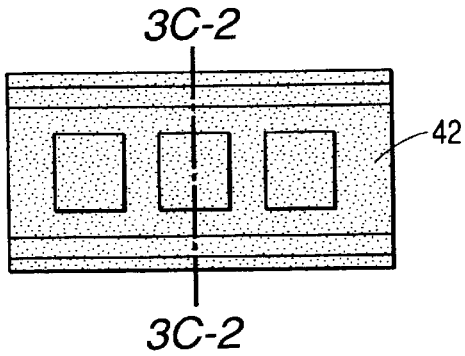
Figures 2, 3C:
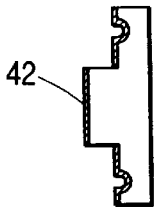

Then epoxy adhesive material, which is shifted to the B-stage with completed shrinkage under UV irradiation while maintaining the tackiness and can be adhered by heating and pressing, was uniformly sprayed on thus worked adhesion face of the orifice plate 40 for adhesion with the main body of the head. Then ultraviolet irradiation was conducted with a power of 1 mW/cm$^2$ for 60 seconds to shift the adhesive to the B-stage thereby completing the setting and shrinkage of the adhesive (FIG. 3C).

Figures 1, 3D:
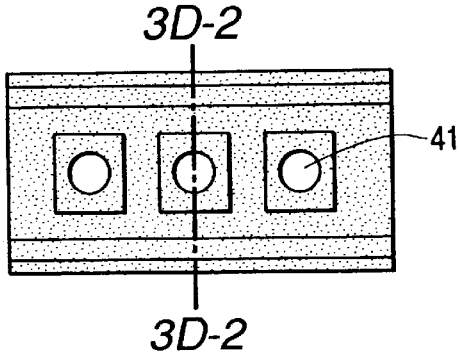
Figures 2, 3D:
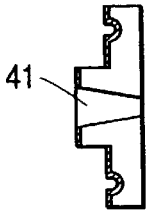

Subsequently the irradiation with the excimer laser beam was conducted from the side of the adhesion face of the orifice plate 40, thereby forming an orifice 41 of a diameter of 22 $\mu$m in each protruding portion (FIG. 3D). The protruding portion 45 provided around the orifice was made to enter the liquid path of the head main body, including the liquid paths 401, the element substrate 100 and the ceiling plate 400 and the orifice plate 40 was adjoined at the recess 46.

Then the orifice plate 40 was maintained in close contact with the main body of the head by applying a pressure of 1 kg/cm$^2$ from the orifice face, and heating was made to 60° C. while such pressed state was maintained to complete the hardening of the adhesive.

The liquid discharge head after the adhesive hardening provided satisfactory printing without streaks or unevenness therein and without the peeling of the orifice plate. The observation, made through the orifice plate, of the adhesion state of the main body of the head and the orifice plate proved the absence of trapped bubble in the adhesion face around the orifice. Also the liquid discharge head, when disassembled and observed, proved absence of any undesirable substance in the orifice or in the liquid path.

[Second Embodiment]

A second embodiment of the present invention will be explained with reference to FIGS. 4A to 4E.

The orifice plate 40 was worked with the KrF excimer laser of a wavelength of 248 nm as in the first embodiment, and the recess, groove and orifice were formed by the apparatus shown in FIG. 9.

Figures 1, 4A:
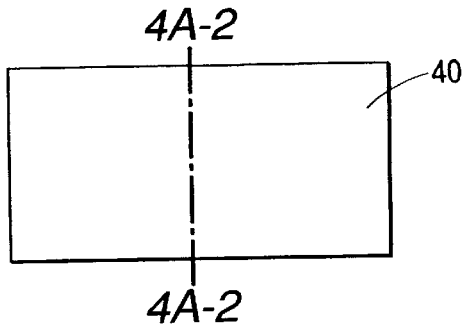
Figures 2, 4A:
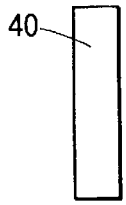
Figures 1, 4B:
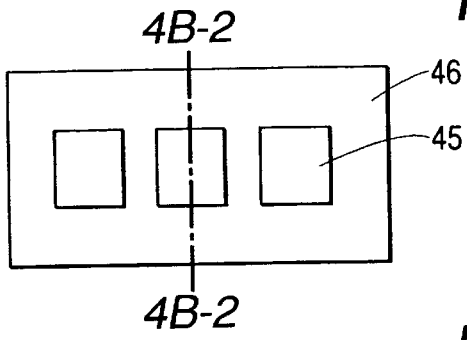
Figures 2, 4B:
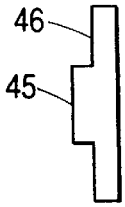

At first a recess 46 was formed on the orifice plate 40 with a depth of 10 $\mu$m in such a manner that plural protruding portions 45 are arranged linearly with a pitch of 1200 dpi and with a size of 15 $\mu$m×15 $\mu$m, thereby forming the adhesion face, having the recess 46, for adhesion with the main body of the head (FIG. 4B).

Figures 1, 4C:
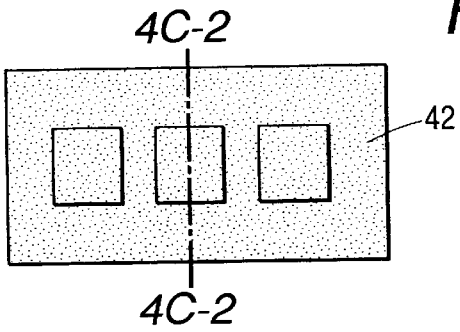
Figures 2, 4C:
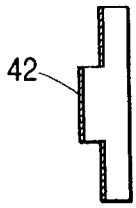
Figures 1, 4D:
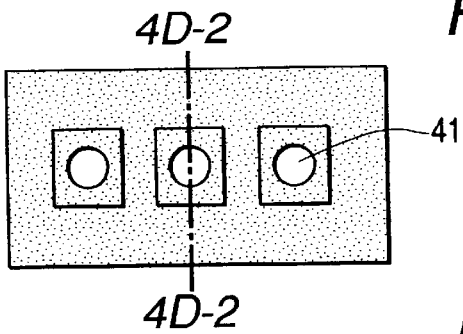
Figures 2, 4D:
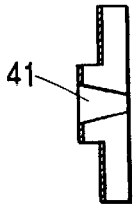

Then epoxy adhesive material, which is shifted to the B-stage with completed shrinkage under UV irradiation while maintaining the tackiness and can be adhered by heating and pressing, was uniformly sprayed on thus worked adhesion face of the orifice plate 40 for adhesion with the main body of the head. Then ultraviolet irradiation was conducted with a power of 1 mW/cm$^2$ for 60 seconds to shift the adhesive to the B-stage thereby completing the setting and shrinkage of the adhesive (FIG. 4C).

Figures 1, 4E:
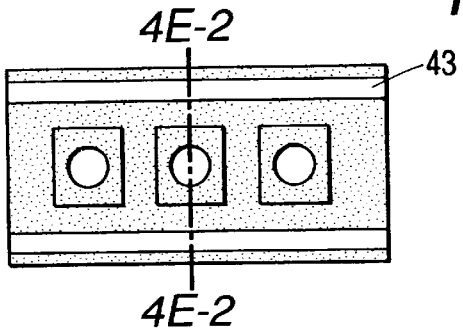
Figures 2, 4E:
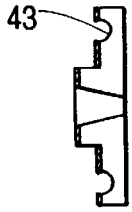

Subsequently the irradiation with the excimer laser beam was conducted from the side of the adhesion face of the orifice plate 40, thereby forming an orifice 41 of a diameter of 11 $\mu$m in each protruding portion and a groove 43 of a width of 20 $\mu$m and a depth of 20 $\mu$m from the bottom of the recess 46 in a position in the recess 46 at a distance of 20 $\mu$m from the protruding portion (FIG. 4E). In the present embodiment, the orifice 41 and the groove 43 were formed simultaneously, but they can also be formed separately. The protruding portion 45 provided around the orifice was made to enter the liquid path of the head main body, including the liquid paths 401, the element substrate 100 and the ceiling plate 400 and the orifice plate 40 was adjoined at the recess 46.

Then the orifice plate 40 was maintained in close contact with the main body of the head by applying a pressure of 1 kg/cm$^2$ from the orifice face, and heating was made to 60°

C. while such pressed state was maintained to complete the hardening of the adhesive.

The sample thus obtained was subjected to evaluation as in the first embodiment. The liquid discharge head after adhesive hardening provided satisfactory printing without streaks or unevenness therein and without the peeling of the orifice plate. The observation, made through the orifice plate, of the adhesion state of the main body of the head and the orifice plate proved the absence of trapped bubble in the adhesion face around the orifice. Also the liquid discharge head, when disassembled and observed, proved absence of any undesirable substance in the orifice or in the liquid path.

[Third Embodiment]

Figures 1, 5A:
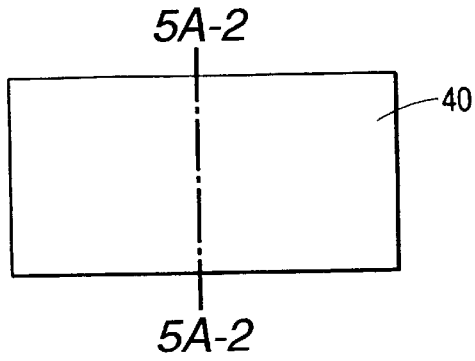
Figures 2, 5A:
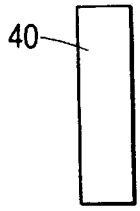

A third embodiment of the present invention will be explained with reference to FIGS. 5A to 5C.

The orifice plate 40 was worked with the KrF excimer laser of a wavelength of 248 nm as in the first embodiment, and the recess, groove and orifice were formed by the apparatus shown in FIG. 9.

Figures 1, 5B:
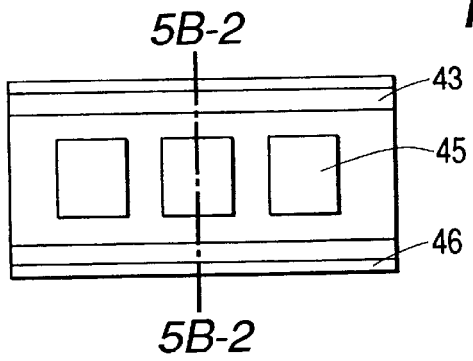
Figures 2, 5B:
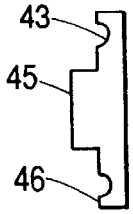

At first a recess 46 was formed on the orifice plate 40 with a depth of 10 $\mu$m in such a manner that plural protruding portions 45 are arranged linearly with a pitch of 1200 dpi and with a size of 15 $\mu$m×15 $\mu$m, thereby forming the adhesion face, having the recess 46, for adhesion with the main body of the head (FIG. 5B).

Figures 1, 5C:
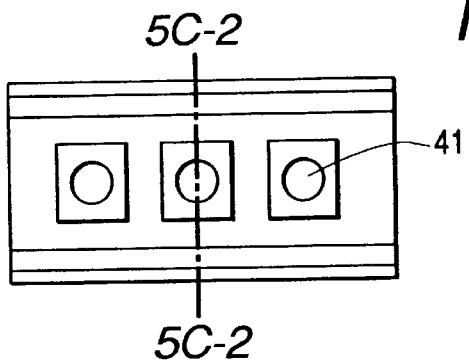
Figures 2, 5C:
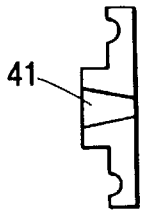
Figure 6:
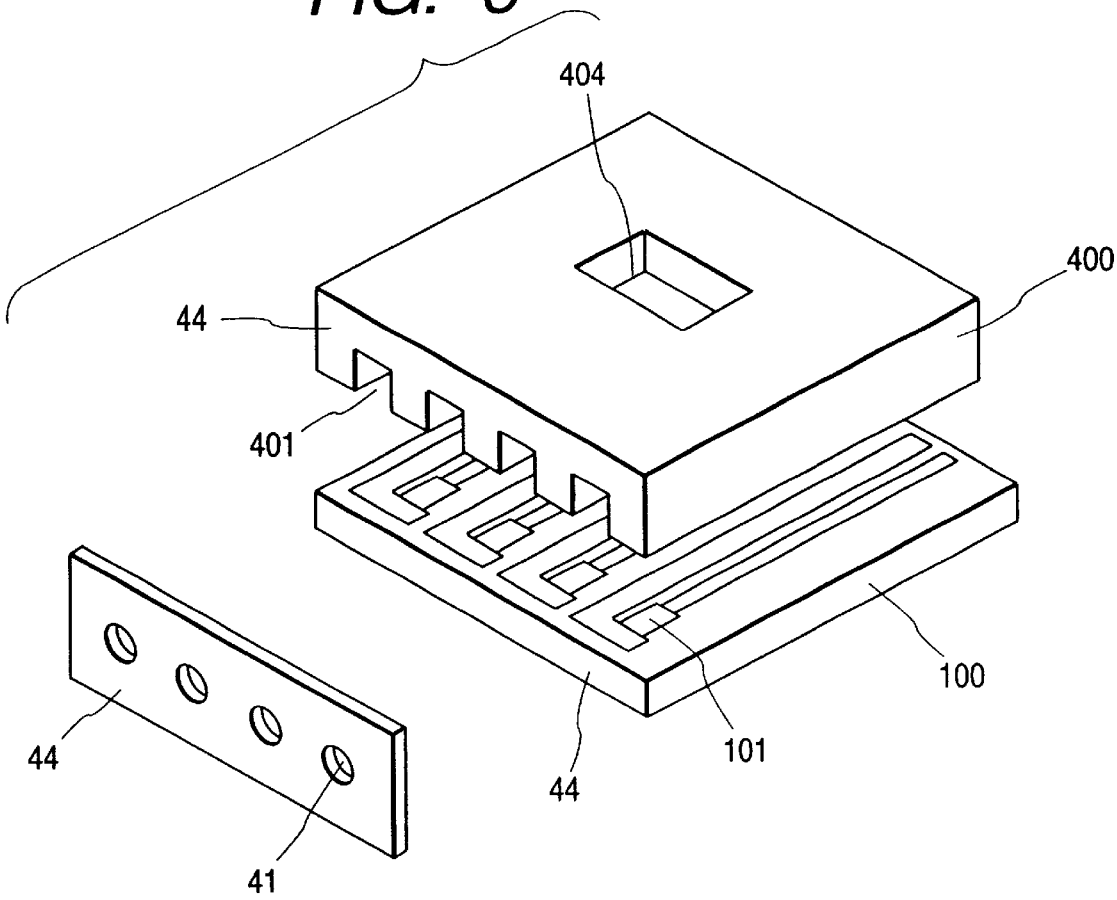
FIG. 6 is an exploded perspective view showing an example of a conventional liquid discharge head.
Figure 7:
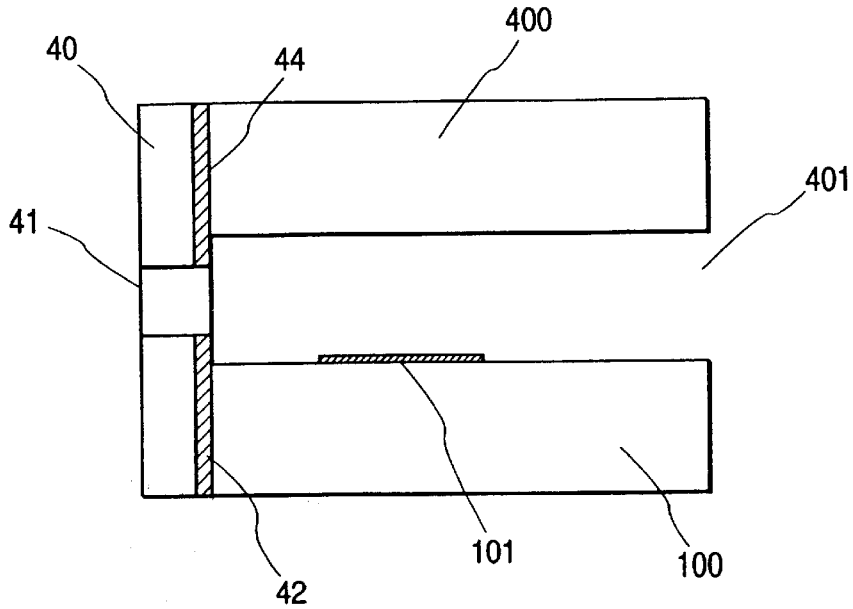
FIG. 7 is a schematic cross-sectional view showing an example of a conventional liquid discharge head.

Subsequently the irradiation with the excimer laser beam was conducted from the side of the adhesion face of the orifice plate 40, thereby forming an orifice 41 of a diameter of 11 $\mu$m in each protruding portion and grooves 43 of a width of 20 $\mu$m and a depth of 20 $\mu$m from the bottom of the recess 46 in a position in the recess 46 at a distance of 20 $\mu$m from the protruding portion (FIG. 5C).

Then epoxy adhesive material, which is shifted to the B-stage with completed shrinkage under UV irradiation while maintaining the tackiness and can be adhered by heating and pressing, was uniformly applied by transfer method onto thus worked adhesion face of the orifice plate 40 for adhesion with the main body of the head. Then ultraviolet irradiation was conducted with a power of 1 mw/cm$^2$ for 60 seconds to shift the adhesive to the B-stage thereby completing the setting and shrinkage of the adhesive (FIG. 4C).

The protruding portion 45 provided around the orifice was made to enter the liquid path of the head main body, including the liquid paths 401, the element substrate 100 and the ceiling plate 400 and the orifice plate 40 was adjoined at the recess 46.

Then the orifice plate 40 was maintained in close contact with the main body of the head by applying a pressure of 1 kg/cm$^2$ from the orifice face, and heating was made to 60° C. while such pressed state was maintained to complete the hardening of the adhesive.

The sample thus obtained was subjected to evaluation as in the first embodiment. The liquid discharge head after adhesive hardening provided satisfactory printing without streaks or unevenness therein and without the peeling of the orifice plate. The observation, made through the orifice plate, of the adhesion state of the main body of the head and the orifice plate proved the absence of trapped bubble in the adhesion face around the orifice. Also the liquid discharge head, when disassembled and observed, proved absence of any undesirable substance in the orifice or in the liquid path.

Figures 1, 8A:
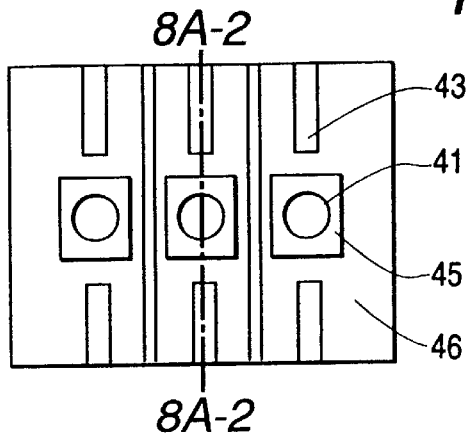
Figures 2, 8A:
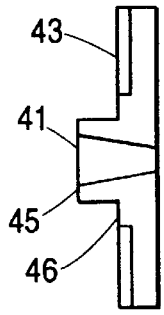
Figures 1, 8B:
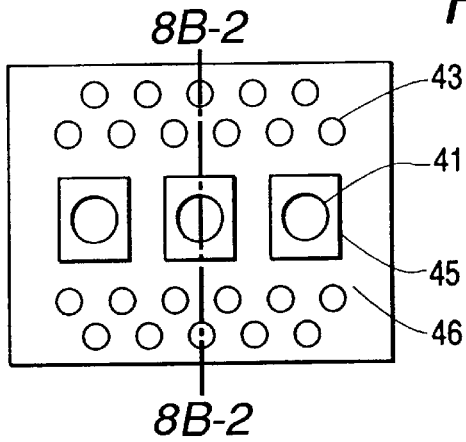
Figures 2, 8B:
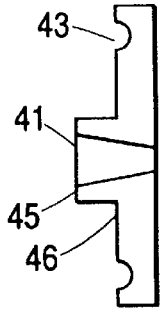
Figures 1, 8C:
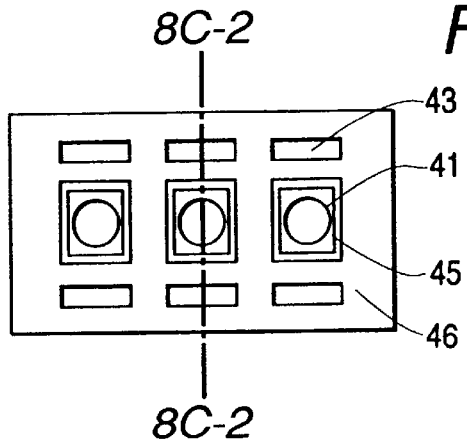
Figures 2, 8C:
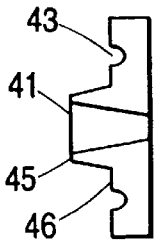

The present embodiment may be so modified that the groove is formed in a pattern (circle, rectangle or tetragon) as shown in FIGS. 8A to 8C, or that the external periphery of the protruding portion of the orifice plate is tapered as shown in FIG. 8C, or that a groove is formed between the discharge openings as shown in FIG. 8A.

[Fourth Embodiment]

Figure 10:
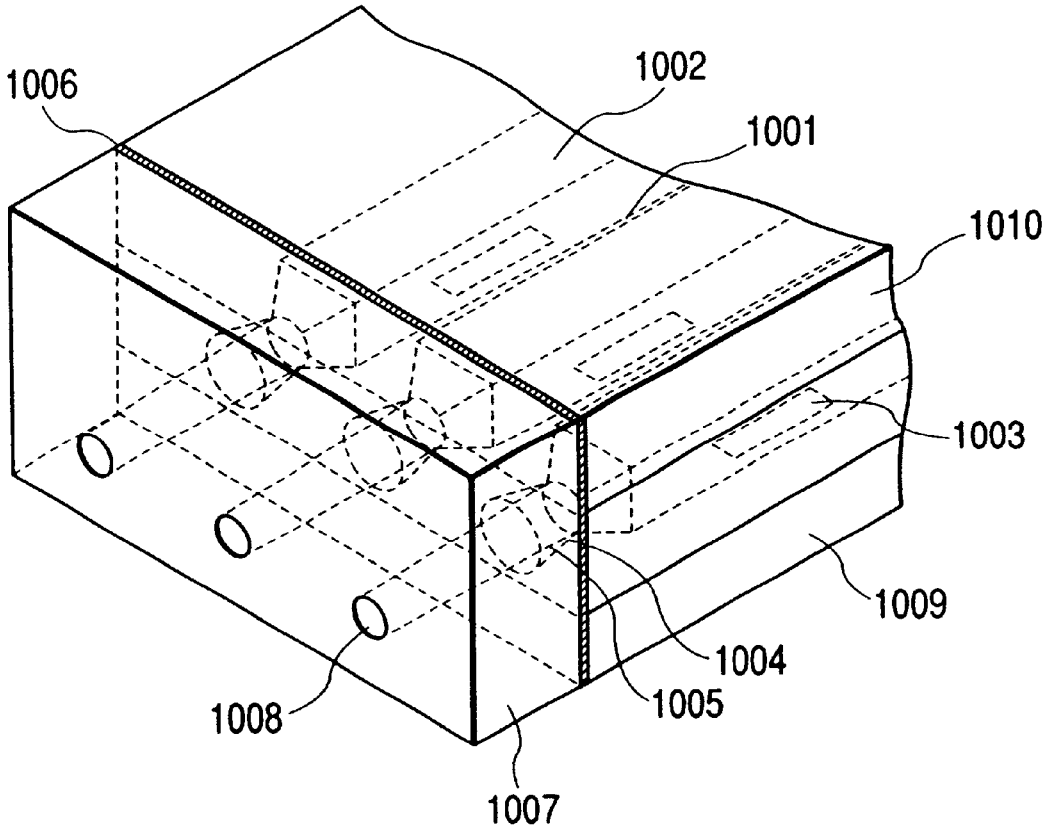
FIG. 10 is a perspective view of a liquid discharge head constituting a fourth embodiment of the present invention.

FIG. 10 is a perspective view of a liquid discharge head, constituting a fourth embodiment of the present invention.

In FIG. 10 there are shown a silicon substrate 1009 constituting the recording head and provided with an electrothermal converting element 1003 for discharging ink; an orifice plate 1007, a projection 1005 formed on the orifice plate; an orifice 1008; a liquid path wall 1001 formed by patterning photosensitive resin laminated on the silicon substrate 1009; a ceiling plate 1010 consisting of a silicon substrate; a liquid path 1002; and a communication aperture 1004 to be used for adhesion with the orifice plate and formed by laser beam irradiation after cutting with the diamond blade. The present embodiment will be explained in detail with reference to the attached drawings.

Figure 11A:
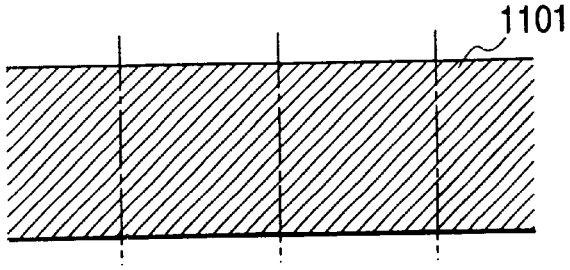
FIGS. 11A, 11B and 11C are cross-sectional views showing steps for forming the orifice plate in a fourth embodiment of the present invention.
Figure 11B:
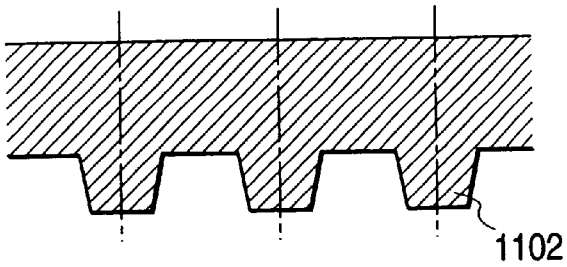
Figure 11C:
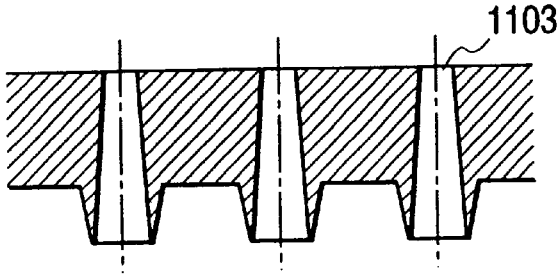

FIGS. 11A to 11C are views showing steps for forming the above-described orifice plate, wherein shown are a resin film 1101, a projection 1102 and an orifice 1103.

At first the resinous film 1101 having satisfactory ink resistance and rigidity such as of polysulfone or polyimide is subjected to the irradiation with the excimer laser beam to form the projection 1102. The irradiation was executed by the imaging method through a mask defining the dimension of the projection, but there may also be utilized the focusing method utilizing a galvanometer. In the laser working, it is already known that a tapered shape of an angle of several degrees is obtained by the by products formed at the working, and such tapered shape is utilized for effecting adhesion with the liquid path to be explained later. In the present embodiment, the projections were formed with an external diameter of 28 $\mu$m, a height of 23 $\mu$m and with a pitch of 70.5 $\mu$m.

Then an orifice 1103 is formed to obtain the orifice plate shown in FIG. 11C. The formation of the orifice 1103 can be formed without positional aberration with respect to the projection, after the formation thereof, with the above-mentioned excimer laser beam without varying the relative position to the optical axis thereof but simply replacing the mask only. In the present embodiment the entrance diameter of the laser beam was selected as 26 $\mu$m and the orifice 1103 could be formed on the projection with a tolerance of ±1 $\mu$m.

Figure 12A:
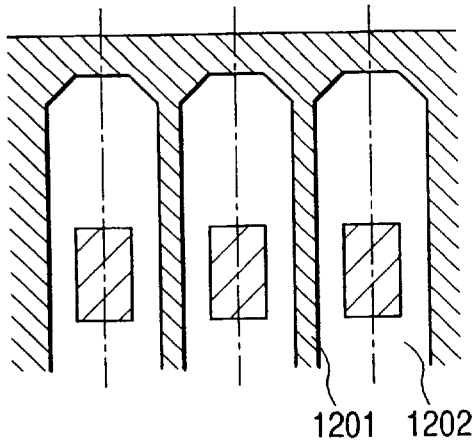
FIGS. 12A, 12B and 12C are cross-sectional views showing steps for forming the liquid path in a fourth embodiment of the present invention.
Figure 12B:
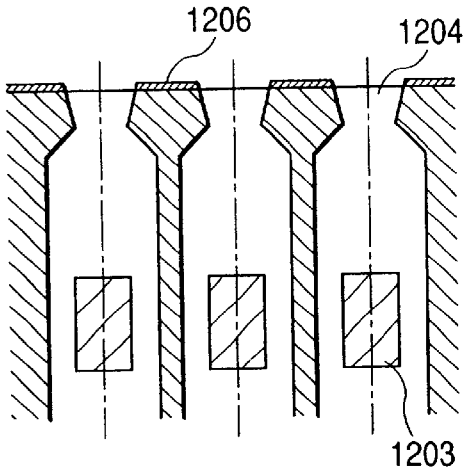
Figure 12C:
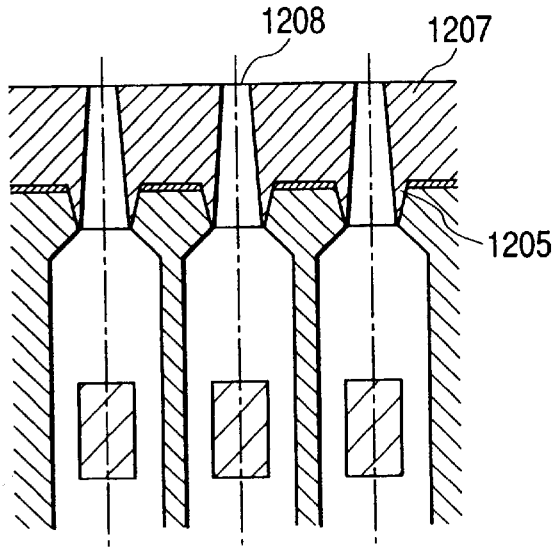

FIGS. 12A to 12C are views showing steps for producing the above-described liquid discharge head.

As shown in FIG. 12A, liquid paths 1202 are defined by liquid path walls 1201 formed by patterning photosensitive resin on a silicon substrate. Subsequently the liquid paths are cut with a diamond blade into a desired size. As apertures 1204 for communication with an orifice plate 1207 are not formed in this state, there is not observed burrs or chipping generated at the cutting operation, or intrusion of cut powder or dusts into the liquid paths 1202. Then, for adhering the orifice plate 1207, adhesive material 1206 consisting of epoxy resin is coated by transfer method on the entire surface of the front end of the liquid paths. Also in this state, as the communication apertures 1204 are not yet formed, the adhesive material does not enter the liquid paths 1202.

Then the front end portion of the liquid path is irradiated with the excimer laser beam through a mask, as in the formation of the orifice 1208 and the projection 1205 of the orifice plate 1207, thereby forming the communication aperture 1204 to be used for adhesion with the orifice plate 1207. The size of the communication aperture 1204 is selected as about 10 $\mu$m, in consideration of the size of the projection 1205. As the adhesive material 1207 is coated prior to the formation of the communication aperture 1204, there can be removed the excessive adhesive entering the liquid path. As a result, there can be obtained a shape as shown in FIG. 12B.

Thereafter the projection 1205 of the orifice plate 1207 is aligned with the communication aperture 1204 at the front end of the liquid path and is adhered by the adhesive material 1206. The alignment can be easily achieved by mutually fitting the projection 1205 of the orifice plate 1207 with the communication aperture 1204 at the front end of the liquid path. The adhesion was executed by heating for temporary adhesion after pressurizing so as to avoid bubble inclusion, followed by main hardening. Such adhering operation allowed to obtain the liquid discharge head as shown in FIG. 12C, without intrusion of the adhesive material. The recording operation with thus obtained liquid discharge head provided satisfactory result, without failure in the liquid discharge induced by the intrusion of the adhesive material or by dusts generated at the cutting operation, and without defective printing caused by burrs or chipping.

[Fifth Embodiment]

In the following there will be explained a fifth embodiment of the present invention.

At first a resinous material with satisfactory ink resistance or rigidity, such as polysulfone or polyimide, is injection molded to obtain a thin plate of a shape as shown in FIG. 11B or 11C. In the injection molding method, the mold is provided with a tapered shape of several degrees, called the extracting inclination, and the molded thin plate is released by such tapered shape. The tapered shape is transferred to the molded article and is utilized for adjoining with the liquid path.

Also the aforementioned orifice formation can be dispensed with if the orifice plate is molded in the shape shown in FIG. 11C by the injection molding.

In the present embodiment, there could be obtained the orifice plate of a thickness of 75 $\mu$m, with a mold temperature of 160° C. and an injection speed of 400 mm/sec.

Thereafter the formation of the liquid path and the adhesion of the orifice plate are conducted in the same manner as in the foregoing embodiments.

The recording operation with thus obtained liquid discharge head provided satisfactory result, without failure in the liquid discharge induced by the intrusion of the adhesive material or by dusts generated at the cutting operation, and without defective printing caused by burrs or chipping.

[Sixth Embodiment]

Figure 13:
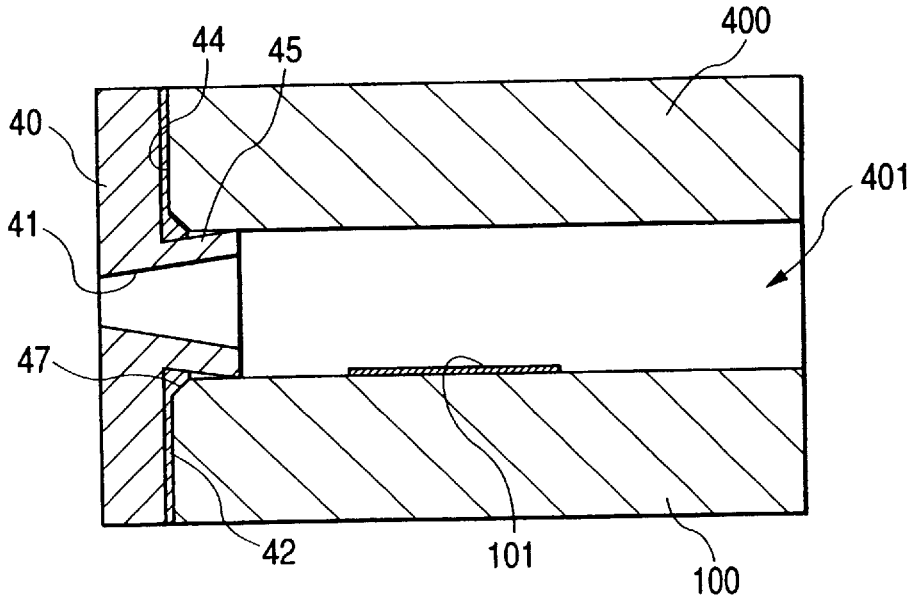
FIG. 13 is a schematic cross-sectional view showing the configuration of the liquid discharge head of a sixth embodiment of the present invention.

FIG. 13 is a schematic cross-sectional view showing the configuration of a liquid discharge head constituting a sixth embodiment of the present invention.

As shown in FIG. 13, the liquid discharge head of the present embodiment is provided with a main body formed by adhering a ceiling plate 400 integrally having grooves for forming the liquid path 401 and the liquid chamber (not shown), and a substrate (heater board) 100. The heater board 100 is obtained by forming, on an Si substrate, an energy generating element (heater) 101 for generating discharge energy and Al wirings (not shown) for supplying the element with an electrical signal, by film forming technology.

On an aperture face 44 (called adhesion face to the head main body) of the main body of the head, where the liquid path is opened, the orifice plate 40 is adjoined with adhesive resin 42. The orifice plate 40 is provided with plural orifices (discharge openings) 41 for discharging ink. Each orifice is so positioned as to communicate with a corresponding liquid path 401. Also in the present embodiment, a face of the orifice plate 40 to be adhered to the main body of the head is provided with an insertion portion 45 which, including the orifice 41, is inserted into the liquid path 401. The external shape of the inserting portion 45 is so formed as to spread from the base part to the end part thereof.

The orifice plate 40 is preferably composed of a metal film such as of stainless steel or Ni, or a plastic film of satisfactory ink resistance such as of polyimide, polysulfone (PSF), polyethersulfone, polyphenylene oxide, polyphenylene sulfide or polypropylene. Otherwise the orifice plate 40 may be formed with silicon (Si) or a ceramic material. In the present embodiment, the orifice plate 40 is composed of a PSF film of a thickness of 50 $\mu$m.

Also in the present embodiment, a beveled portion 47 is provided on the edge of the aperture of the liquid path 401 in the head main body. Also in the present embodiment, as the adhesive resin 42 for adhering the orifice plate 40, there is employed epoxy resin of photosetting or thermo-setting that can be hardened by ultraviolet (UV) irradiation, infrared irradiation or heating.

Figures 14A, 14B, 14C:
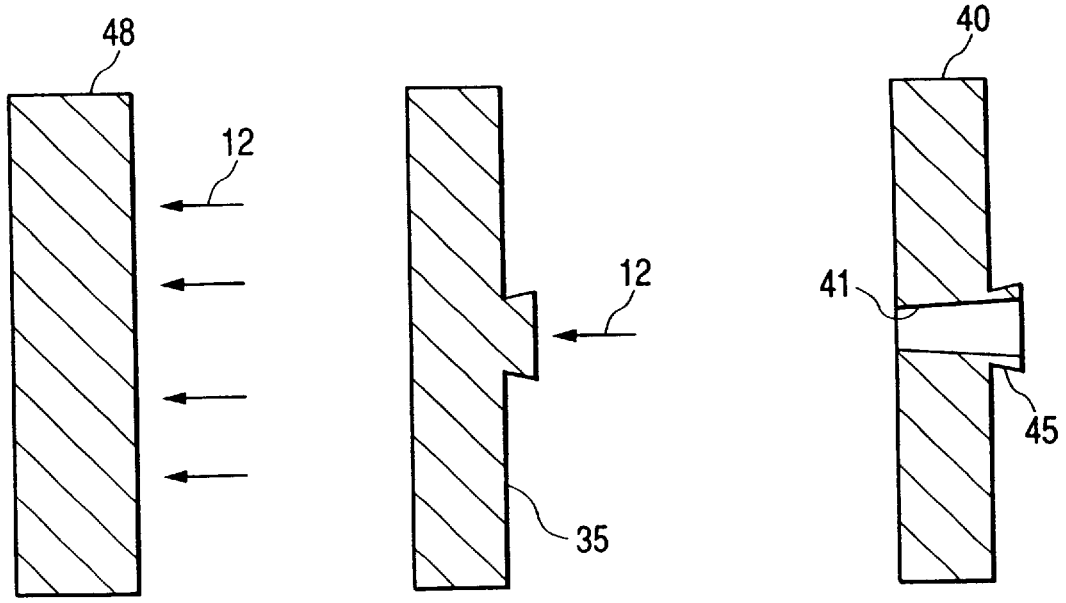
FIGS. 14A, 14B and 14C are views showing steps of forming the orifice plate shown in FIG. 13.

FIGS. 14A to 14C are views showing steps for forming the orifice plate shown in FIG. 13.

The formation of the orifice plate 40 is executed by the apparatus shown in FIG. 9, by at first irradiating a face of an orifice plate base member 48, for constituting the adhesion face with the head main body, with a laser beam 12 (FIG. 14A) to form a recess, excluding the inserting portion 45 of the orifice plate 40, with a depth of 10 $\mu$m from the top of the inserting portion 45, thereby forming the adhesion face 35 with the head main body (FIG. 14B).

Then the excimer laser beam 12 is directed from the side of the adhesion face of the orifice plate 40 to form an orifice 41 in each inserting portion 45 (FIG. 14C).

In this manner the orifice plate 40 shown in FIG. 13 is obtained by laser working. In the present embodiment, the plural inserting portions 45 are formed linearly with a pitch of 600 dpi, on the adhesion face of the orifice plate 40 with the head main body.

In the following there will be explained the assembling steps of the liquid discharge head shown in FIG. 13, with reference to FIGS. 15A to 15C.

Figure 15A:
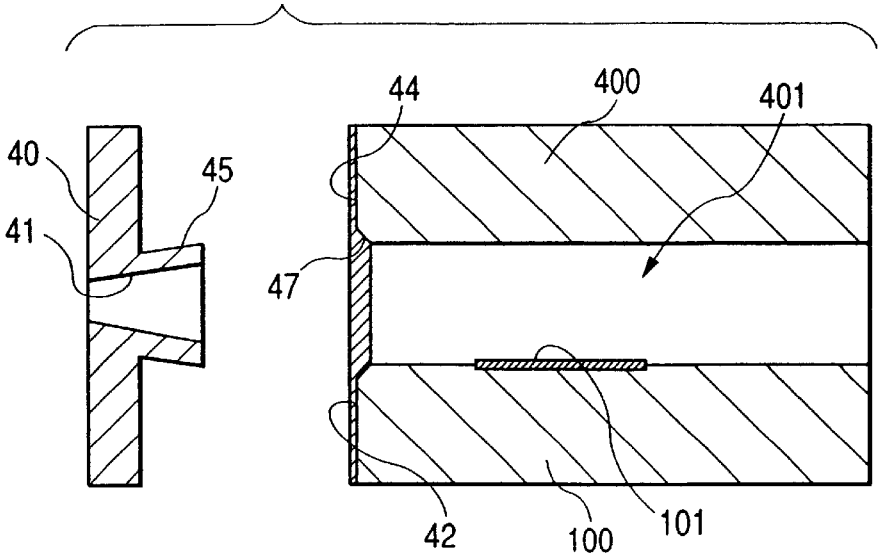
FIGS. 15A, 15B and 15C are views showing steps of assembling the liquid discharge head shown in FIG. 13.
Figure 15B:
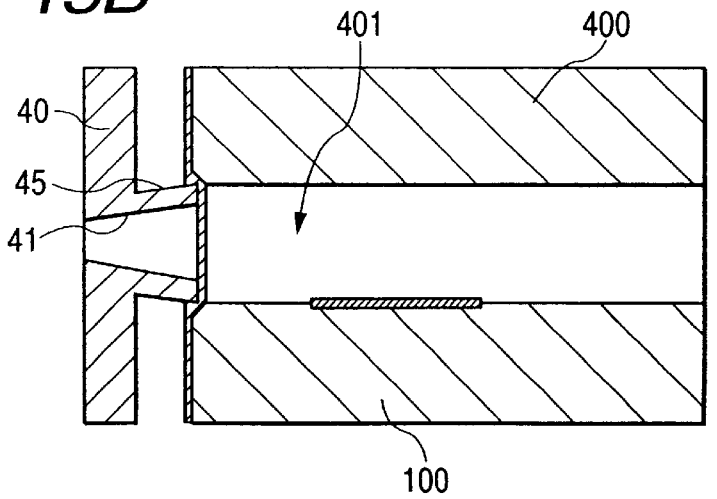
Figure 15C:
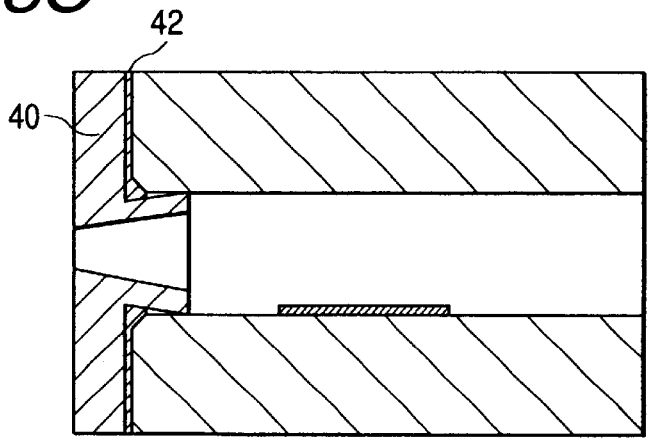

In assembling the liquid discharge head, as shown in FIG. 15A, at first the epoxy adhesive resin is uniformly coated on a resin sheet or a rubber sheet (both not shown), and the adhesive resin on the sheet is transferred onto the adhesion face (adhesion face 44) of the head main body with the orifice plate 40. Then the adhesive resin 42, coated on the adhesion face 44 of the main body of the head, is irradiated with ultraviolet light, whereby the adhesive resin 42 is shifted to the B-stage and completes setting and shrinkage.

Then the inserting portion 45, provided around the orifice 41 in the orifice plate 40, is inserted into the liquid path 401 of the main body of the head, formed by the element substrate 100 and the ceiling plate 400.

As the edge portion of the liquid path 401 has a beveled portion 47 (cf. FIG. 15A), even if the front end of the inserting portion 45 interferes with the edge of the liquid path 401, the inserting portion 45 can be smoothly inserted into the liquid path 401 by pressing in the orifice plate 40. Consequently the inserting portion 45 can be inserted into the liquid path 401 in a state in which the end of the inserting portion 45 is maintained in contact with the internal surface of the liquid path 401. It is therefore possible to prevent intrusion of the adhesive resin 42 into the orifice 41 and the liquid path 401, at the adhering step of the orifice plate 40.

Finally, the orifice plate 40 is pressed to the main body of the head by a pressure of 1 kg/cm$^2$ on the orifice plate 40, and heating is executed at 60° C. in such pressed state, thereby hardening the adhesive resin 42.

The liquid discharge head of the present embodiment can be prepared through the above-described steps.

In the liquid discharge head of the present embodiment, the inserting portion 45 including the orifice 41 is inserted into the liquid path 401 and the end part of the inserting portion 45 is in contact with the internal wall of the liquid path 401, so that the liquid (ink) flow from the liquid path 401 to the orifice 41 is hardly hindered and satisfactory liquid discharge can be realized in stable manner.

Also in the present embodiment, the external shape of the inserting portion 45 provided on the orifice plate 40 is so formed as to expand from the base part to the end part. Consequently the adhesive resin 42 is filled in the gap between the base part of the inserting portion 45, inserted into the liquid path 401, and the internal walls of the liquid path 401 to increase the adhesion strength between the orifice plate 40 and the main body of the head in the vicinity of the orifice 41. In addition, even if the linear expansion coefficient of the orifice plate 40 is larger than that of the main body of the head, no force is generated in a direction to expel the inserting portion 45 from the liquid path 401 of the head main body when the inserting portion 45 expands at the thermal hardening step of the adhesive resin 42, so that there can be prevented the positional aberration between the orifice plate 40 and the main body of the head at the adhering step, resulting from the difference in the linear expansion coefficient therebetween. Therefore, the liquid discharge head of the present embodiment can execute the liquid discharge in satisfactory and stable manner.

The liquid discharge head after adhesive hardening provided satisfactory printing without streaks or unevenness therein and without the peeling of the orifice plate. Also the liquid discharge head, when disassembled and observed, proved absence of any undesirable substance such as adhesive resin 42 in the orifice 41 or in the liquid path 401.

In the present embodiment, there has been explained the method of irradiating the adhesive resin 42 with ultraviolet light thereby shifting it to the B-stage, but there may also be employed resin which is shifted to the B-stage by infrared irradiation of a predetermined wavelength. Otherwise, the adhesive resin 42 may also be composed of resin which is shifted to the B-stage by heating.

[Seventh Embodiment]

Figure 16A:
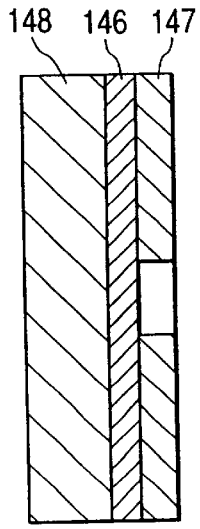
FIGS. 16A, 16B and 16C are views showing steps for forming the orifice plate in a seventh embodiment of the present invention.
Figure 16B:
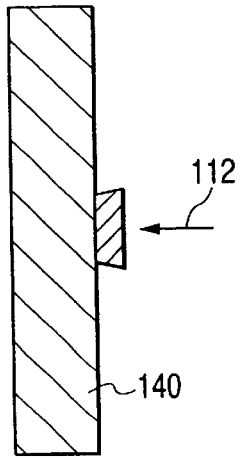
Figure 16C:
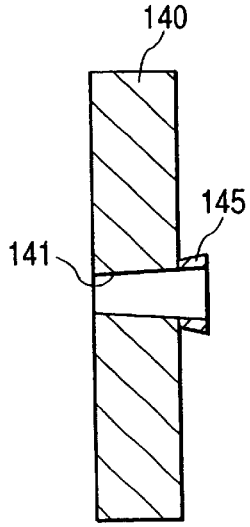

FIGS. 16A to 16C are views showing steps for forming the orifice plate in the liquid discharge head of a seventh embodiment of the present invention.

The orifice plate 140 in the present embodiment is formed at first by laminating photosensitive resin 146 of negative working type with satisfactory ink resistance, on a face of an orifice plate base member 148 consisting of a polysulfone sheet, for constituting the adhesive face with the main body of the head. Then, on the photosensitive resin 146, there is formed a resist 142 having the pattern for forming an inserting portion 145 in the photosensitive resin 146 (FIG. 16A).

Then the orifice plate 140 is irradiated with a laser beam 112 (FIG. 16B) and the photosensitive resin 146 is exposed and developed to form the inserting portion 145 therein.

Then the excimer laser beam is irradiated from the side of the adhesion face of the orifice plate 140 with the main body of the head, thereby forming an orifice 141 in each inserting portion 145 (FIG. 16C). The orifice 141 is formed, with the apparatus shown in FIG. 9, by irradiation of the KrF excimer laser beam of a wavelength of 248 nm. Thus the orifice plate 140 of the present embodiment is formed through the photolithographic process.

The orifice plate 140 thus obtained is adhered to the main body of the head, through a process same as the assembling process explained with reference to FIGS. 15A to 15C.

Also in the liquid discharge head of the present embodiment, as in the sixth embodiment, the inserting portion 145 including the orifice 141 is inserted into the liquid path (not shown) and the end part of the inserting portion 145 is in contact with the internal wall of the liquid path, so that the liquid (ink) flow from the liquid path to the orifice 141 is hardly hindered and satisfactory liquid discharge can be realized in stable manner.

Further, also in the present embodiment, the external shape of the inserting portion 145 is so formed as to expand from the base part to the end part. Consequently the adhesive resin (not shown) is filled in the gap between the base part of the inserting portion 145, inserted into the liquid path, and the internal walls of the liquid path to increase the adhesion strength between the orifice plate 140 and the main body of the head in the vicinity of the orifice 141. In addition, there can be prevented the positional aberration between the orifice plate 140 and the main body of the head at the adhering step, resulting from the difference in the linear expansion coefficient therebetween.

In the foregoing embodiments, the orifice plate 40, 140 is formed by a laser working process or a photolithographic process, but the orifice plate of the present invention may also be formed for example by press molding utilizing a mold.

[Eighth Embodiment]

In the above-described configuration of providing the orifice plate with a protruding portion and fitting the protruding portion into the liquid path, the fitting may not be achieved satisfactorily depending on the environmental temperature, in case the head main body and the orifice plate having different linear expansion coefficients are adjoined. Such situation becomes conspicuous when thermosetting adhesive is employed. Also in the above-described configuration, the fitting may not be achieved satisfactorily with an increase in the density of the orifices, as the tolerance of the fitting becomes stricter. Particularly in case a large number of orifices are formed linearly as in the full-line head, the amount of positional aberration increases at both ends, so that the defective fitting tends to occur.

In the present embodiment, therefore, there is provided a liquid discharge head and a producing method therefor, capable of securely adjoining the orifice plate and the main body of the head even in the presence of a change in the environmental temperature, while adopting a configuration for preventing the intrusion of the adhesive resin into the liquid path at the adhesion of the orifice plate and the main body of the head with adhesive resin.

The liquid discharge head of the present embodiment, provided with a head main body in which plural liquid paths, respectively provided with energy generating elements for generating energy for liquid discharge and arranged in mutually parallel manner, are opened on an end face, and an orifice plate, which is adhered to the above-mentioned end face of the head main body with an adhesive material, and is provided with orifices communicating with the liquid paths and with plural protruding portions fitting with the liquid paths, in positions respectively corresponding to the liquid path:

wherein pitch A of arrangement of the liquid paths, width B of the liquid path, width C of the protruding portion in the direction of arrangement, height D of the liquid path, width E of the protruding portion in a direction perpendicular to the direction of arrangement thereof, linear expansion coefficient a of the head main body, linear expansion coefficient b of the orifice plate, number n of the liquid paths, and environmental temperature difference Δt between before and after the adhesion of the head main body and the orifice plate satisfy the following two conditions:

$$(B-C)/2 \geqq |(a-b)\times n\times A\times \Delta t|,$$

and $$(D-E)/2 \geqq |(a-b)\times D\times \Delta t|.$$

Also the method of the present embodiment for producing the liquid discharge head comprises:

a step of preparing a head main body in which plural liquid paths, respectively provided with energy generating elements for generating energy for liquid discharge and arranged in mutually parallel manner, are opened on an end face;

a step of forming, on an adhesion face to be adhered to the head main body of an orifice plate to be adhered to the end face of the head main body, plural protruding portions adapted to fit with the liquid paths in such a manner that pitch A of arrangement of the liquid paths, width B of the liquid path, width C of the protruding portion in the direction of arrangement, height D of the liquid path, width E of the protruding portion in a direction perpendicular to the direction of arrangement thereof, linear expansion coefficient a of the head main body, linear expansion coefficient b of the orifice plate, number n of the liquid paths, and environmental temperature difference Δt between before and after the adhesion of the head main body and the orifice plate satisfy the following two conditions:

$$(B-C)/2 \geqq |(a-b)\times n\times A\times \Delta t|,$$

and $$(D-E)/2 \geqq |(a-b)\times D\times \Delta t|;$$

a step of coating adhesive resin on the adhesion face of the orifice plate, having the protruding portions, with the head main body or on the adhesive face of the orifice plate with the head main body, a step of forming an orifice in each protruding portion;

a step of fitting the protruding portions respectively with the liquid paths thereby contacting the head main body with the orifice plate under pressure; and a step of hardening the adhesive resin in a state where the head main body and the orifice plate are in contact under pressure.

In the above-described configuration, protruding portions containing orifices are formed in the adhesion face of the orifice plate with the main body of the head and are fitted in the liquid path to adjoin the main body of the head and the orifice plate. Therefore, even when the liquid paths are arranged with a high density, the orifice plate and the main body of the head can be adjoined with satisfactory alignment between the liquid paths and the orifices and without intrusion of the adhesive resin into the orifices or liquid paths. In the liquid discharge head of the present embodiment, the materials constituting the orifice plate and the main body of the head and the dimensions of the fitting portions thereof are so determined as to satisfy the foregoing two conditions in consideration of the change in environmental temperature between before and after the adhesion of he head main body and the orifice plate, so that there can be prevented the failure in the fitting of the protruding portions and the liquid paths resulting from the difference in the linear expansion coefficient between the main body of the head and the orifice plate.

Also in the method for producing the liquid discharge head, the orifice is preferably formed by laser working in case the orifice plate is composed of a resinous film, and, in the present invention, there is adopted a configuration of forming a protruding portion on the orifice plate and fitting such protruding portion into the liquid path. Therefore, by forming the orifice in such protruding portion, the orifice and the liquid path can be aligned even after the formation of the orifice, and the formation of the orifice by laser working can be executed prior to the adhesion of the orifice plate and the main body of the head thereby preventing the intrusion of undesired substances, generated at the laser working, into the liquid path.

The present embodiment will be clarified further in the following, with reference to the attached drawings.

Figure 17:
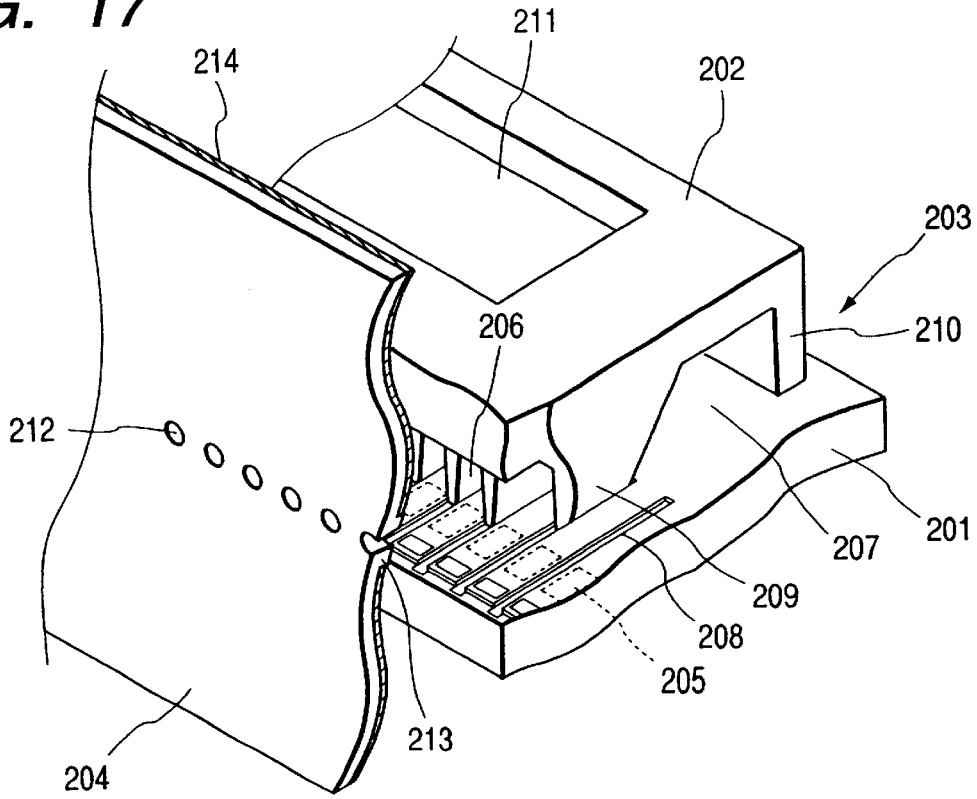
FIG. 17 is a partially broken schematic perspective view of the liquid discharge head of an eighth embodiment of the present invention.

FIG. 17 is a partially-broken schematic perspective view showing the liquid discharge head of the present embodiment.

Figure 18:
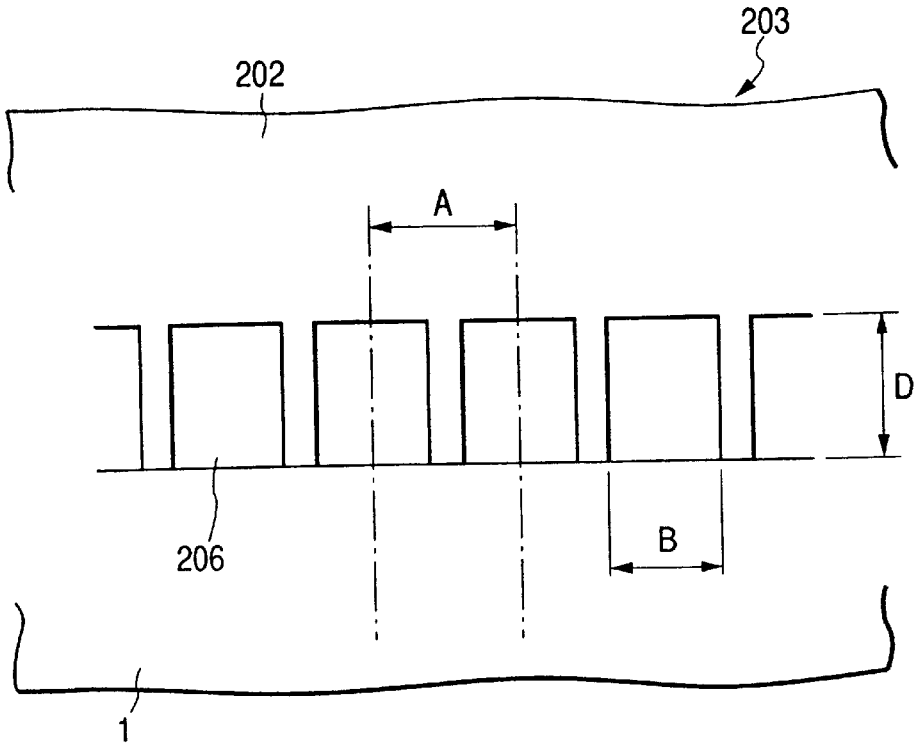
FIG. 18 is a view of the head main body shown in FIG. 17, seen from a face where the orifice plate is to be adhered.

As shown in FIG. 17, the liquid discharge head of the present embodiment has a head main body 203 provided with plural heat generating elements 205 constituting the energy generating elements for generating discharge energy to be given to the ink and with plural liquid paths 206 respectively corresponding to the heat generating elements 205, and an orifice plate 204 adjoined to the head main body 203. As shown in FIG. 18, the liquid paths 206 have apertures on an end face of the main body 203, and the orifice plate 204 is adjoined to such end face. The orifice plate 204 is provided with plural orifices 212 respectively communicating with the liquid paths 206.

The main body 203 is composed of a substrate 201 and a ceiling plate 202 adjoined to the upper face of the substrate 201. On the substrate 201, there are formed the above-mentioned heat generating elements 205 and Al wirings for supplying the heat generating elements 205 with electrical signals, by film forming technology. On the ceiling plate 202, there is integrally formed a liquid chamber frame 210 for forming liquid path walls 209 defining the liquid paths 206 and a common liquid chamber 207 for temporarily storing the ink to be supplied to the liquid path 206, and the liquid paths 206 and the common liquid chamber 207 are formed by adjoining the ceiling plate 202 to the substrate 201. In the ceiling plate 202, there is opened an Ink supply aperture 211 for supplying the common liquid chamber 207 with ink from the exterior. On the substrate 201, grooves 208 are formed, in positions between the heat generating elements 205, for receiving the liquid path walls 209 of the ceiling plate 202, and the ceiling plate 202 and the substrate 201 are mutually aligned at the adjoining thereof by fitting the liquid path walls 209 into the grooves 208.

In the above-described liquid discharge head, the ink supplied from the common liquid chamber 207 into the liquid path 206 is filled therein, forming a meniscus at the orifice 212. When heat is generated by activating the heat generating element in this state, the ink thereon is rapidly heated to generate a bubble by the film boiling phenomenon in the liquid path 206, and the ink is discharged from the orifice 212 by the pressure generated by the growth of such bubble.

Figure 19A:
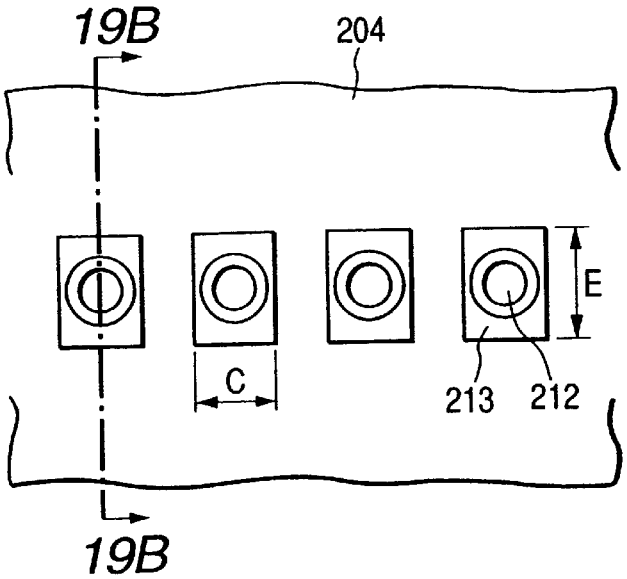
FIGS. 19A and 19B are views showing the orifice plate shown in FIG. 17, respectively a view seen from the back side, and a cross-sectional view along a line 19B—19B in FIG. 19A in a state coated with adhesive resin.
Figure 19B:
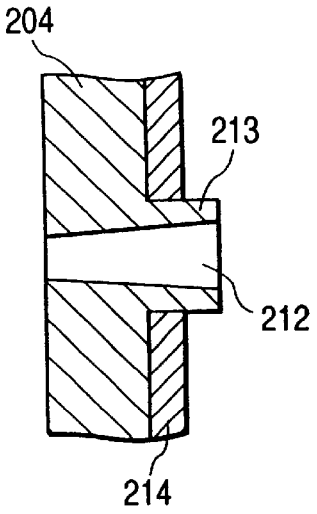

The orifice plate 204 will be explained further in the following. The orifice plate 204 is adhered to the main body 203 of the head with adhesive resin 214 to be explained later, and an adhering face (rear face) of the orifice plate 204, adhered to the main body 203, is provided with protruding portions 213 to respectively fit into the liquid paths 206 of the main body 203. As shown in FIGS. 19A and 19B, the protruding portions 213 are arranged with a predetermined pitch on the rear face of the orifice plate 204, and the orifices 212 are opened on such protruding portions 212. Thus, by fitting the protruding portions 213 in the liquid paths 206 of the main body 203 and adjoining the orifice plate 204 and the main body 203, it is rendered possible to align the orifices 212 with the liquid paths 206 in the adjoining of the orifice plate 204 and the main body 203 even if the liquid paths 206 are arranged with a high density.

The orifice plate 204 is preferably composed of a metal film such as of stainless steel or Ni, or a resinous film with satisfactory ink resistance such as of polyimide, polysulfone, polyethersulfone, polyphenylene oxide, polyphenylene sulfide or polypropylene. In the present embodiment, the orifice plate 204 was composed of a PSF film of a thickness of 50 $\mu$m.

The adhesive resin 214 for adhering the orifice plate 204 and the main body 203 of the head is composed of epoxy adhesive resin which is shifted to the B-stage with completed shrinkage by ultraviolet irradiation, infrared irradiation, heating or a combination of these processes, while maintaining the tackiness and is hardened by additionally executing the above-mentioned processes. In the present embodiment there is employed epoxy resin which is shifted to the B-stage by ultraviolet irradiation and is hardened by additional ultraviolet irradiation or heating. This adhesive material can also achieve adhesion by heating and pressing only.

In the following there will be explained an example of the method for producing the above-described liquid discharge head.

At first the substrate 201 and the ceiling plate 202 are prepared and are mutually adjoined. The method of preparing and adjoining the substrate 201 and the ceiling plate 202 is same as in the prior art and will not, therefore, be explained further.

Then the protruding portions 213 and the orifices 212 are formed on the orifice plate 204. The formation can be achieved by laser working with an apparatus as shown in FIG. 9.

In laser working of the orifice plate 204, at first the protruding portions 213 are formed in plural units in a linear array with a pitch of 600 dpi, and then the orifice 212 is formed in each protruding portion 213. In the present embodiment, prior to the formation of the orifices 212, the adhesive resin 214 is uniformly coated on the adhesion face with the main body 203 as shown in FIGS. 19A and 19B and is shifted to the B-stage state while maintaining the tackiness by UV irradiation.

The orifice 212 is opened by irradiation of the laser beam 12 from the side of the adhesion face with the main body 203. Therefore the orifice 212 is so tapered that the diameter decreases toward the ink discharging direction, and the direction of ink discharge is stabilized when the orifice plate 204 is adjoined with the main body 203 of the head.

After the preparation of the orifice plate 204, the protruding portions 213 thereof are fitted in the apertures of the liquid paths 206 of the main body 203. Then the orifice plate 204 is brought into close contact with the main body 203 by pressing the orifice plate 204 thereto with a pressure of 10 kg/cm$^2$. Both members are heated at 60° C. in such pressed state to complete the hardening of the adhesive resin 214. Thus the main body 203 of the head and the orifice plate 204 are mutually adjoined across the adhesive resin 214 as shown in FIGS. 20A and 20D, whereupon the liquid discharge head is completed.

Figure 20A:
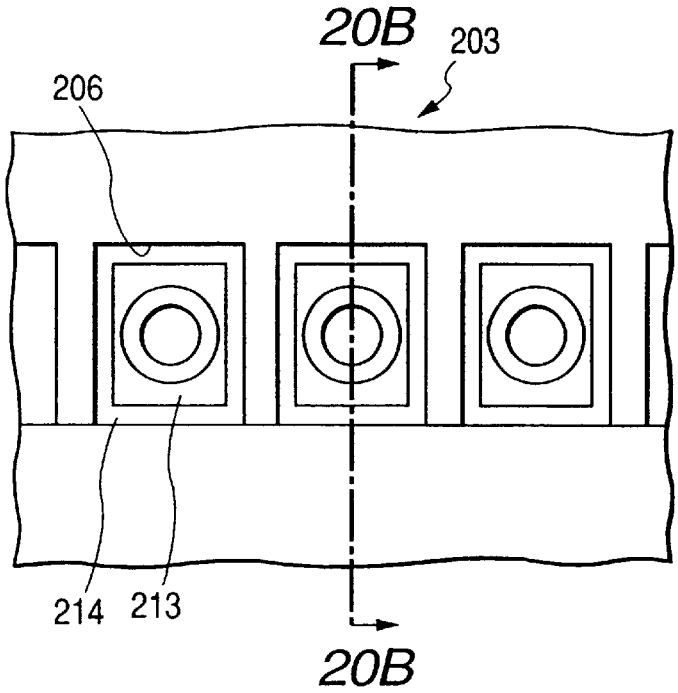
FIGS. 20A and 20B are views showing the fitting structure of a protruding portion and a liquid path in a state where the head main body and the orifice plate are adhered in the liquid discharge head shown in FIG. 17, respectively a view seen from the common liquid chamber and a cross-sectional view along a line 20B—20B in FIG. 20A.
Figure 20B:
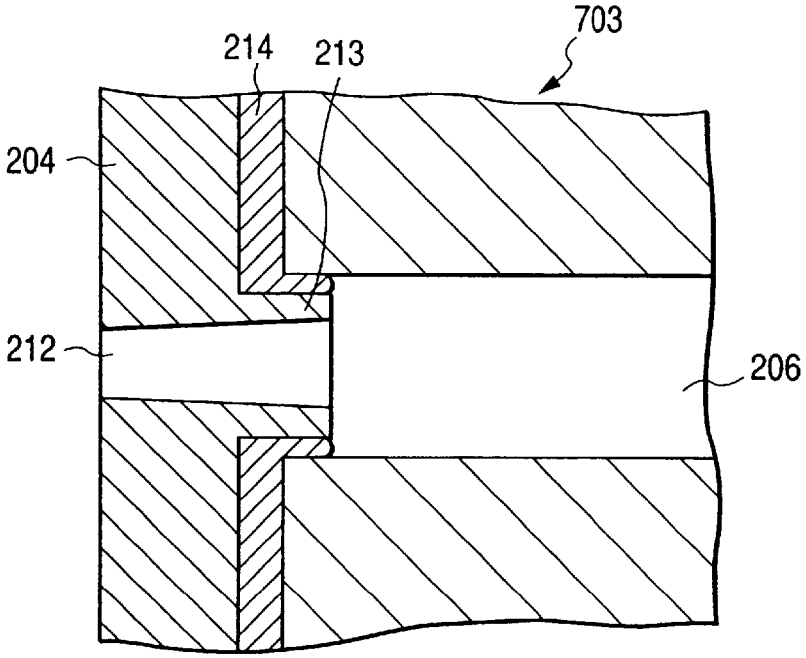

As shown in FIGS. 20A and 20B, the adhesive resin 214 partly enters the liquid path 206 by the pressed contact of the main body 203 and the orifice plate 204, but, because of the presence of the protruding portion 213 thereon, the adhesive resin 214 does not enter the orifice 212 but the gap between the external periphery of the protruding portion 213 and the liquid path walls 206. As a result, there can be prevented the defective ink discharge caused by the intrusion of the adhesive resin 214 into the orifice 212. Also, as the formation of the orifice 212 by laser working is executed prior to the adjoining of the main body 203 and the orifice plate 204, the liquid path 206 can be protected from the intrusion of undesirable substances such as carbon particles generated by the ablation in the laser working. Consequently there does not take place clogging of the orifice 212 by such substances or adhesion of such substances onto the heat generating element 205, and there can be prevented the defective discharge resulting from these phenomena.

In the present embodiment, the orifice plate 204 and the main body 203 of the head are adhered with thermosetting adhesive resin 214 as explained in the foregoing, so that, if the orifice plate 204 and the main body 203 are mutually different in the linear expansion coefficient, there may be encountered a situation where the protruding portion 213 cannot be fitted in the liquid path 206 or the pitch of the protruding portions 213 becomes aberrated from that of the liquid paths 206 to hinder adequate adjoining of the orifice plate 204 and the main body 203, depending on the change of the environmental temperature between before and after the adjoining operation.

In the present embodiment, therefore, the dimensions of the protruding portion 213 and the liquid path 206 are so designed that the difference in the thermal expansion amount between the orifice plate 204 and the main body 203, in the direction of array of the liquid path 206 and in the direction of height thereof under the environmental temperature change, is smaller than the gap between the protruding portion 213 and the liquid path 206 when they are mutually fitted. More specifically, the materials of the orifice plate 204 and the main body 203 of the head and the dimensions of various parts are selected in such a manner that the lateral width C of the protruding portion 213 (width in the direction of array), vertical width E of the protruding portion 213 (in a direction perpendicular to the direction of array), and linear expansion coefficient b with respect to the orifice plate 204; the pitch A of array of the liquid paths 206, width B of the liquid path 206, height D thereof and linear expansion coefficient a width respect to the main body 203 of the head; number n of the protruding portions 213 or the liquid paths 206; and environmental temperature difference $\Delta t$ between before and after the adhesion of the main body 203 and the orifice plate 204 satisfy the following two conditions;

$$(B-C)/2 \geqq |(a-b)\times n\times A\times \Delta t| \quad (1)$$

and $$(D-E)/2 \geqq |(a-b)\times D\times \Delta t| \quad (2).$$

The selection of the materials constituting the orifice plate 204 and the main body 203 of the head and of the dimensions of various parts so as to satisfy the foregoing conditions (1) and (2) avoids positional aberration between the protruding portions 213 of the orifice plate 204 and the liquid paths 206 of the main body 203 at the heated pressing of the two, even in the presence of a difference in the linear expansion coefficient therebetween, so that the failure in the adjoining of the two can be avoided. Also, since the condition (1) takes the pitch of array of the liquid paths 206 and the entire width thereof in the direction of array into consideration, the orifice plate 204 and the main body 203 can be securely adjoined even in case the liquid paths 206 are arranged with a high density or are provided in a large number as in the case of a full-line head. Also if the orifice plate 204 is composed of a light-transmitting material, the orifice plate 204 and the main body 203 are not positionally aberrated by heating, after the adhesive resin 214 is hardened by ultraviolet or infrared light.

In the following there will be explained specific examples of the parameters relating to the conditions (1) and (2) in the liquid discharge head of the present embodiment. For example, if the main body 203 of the head is composed of silicon and the orifice plate 204 is composed of polysulfone, the linear expansion coefficient a of the main body 203 is $2.42\times10^{-6}$, while the linear expansion coefficient b of the orifice plate 204 is $5.5\times10^{-5}$. Other parameters are selected as follows: the number n of the liquid paths as 1200; pitch A of array of the liquid paths as 0.0425 mm; width B of the liquid path as 0.033 mm; height D thereof as 0.05 mm; lateral width C of the protruding portion as 0.028 mm; vertical width E of the protruding portion as 0.048 mm; and environmental temperature difference $\Delta t$ as 2° C.

These parameters, when applied to the conditions (1) and (2), satisfy the condition (2) as the left-hand term becomes $1\times10^{-3}$ mm while the right-hand term becomes $5.3\times10^{-6}$ mm, but does not satisfy the condition (1) as the left-hand term becomes $2.5\times10^{-3}$ mm while the right-hand term becomes $5.4\times10^{-3}$ mm. Stated differently, the configuration is satisfactory in the vertical direction of the liquid paths 206, but, in the direction of array thereof, the positional aberration between the protruding portions 213 and the liquid paths 206 becomes excessively large by thermal expansion whereby the orifice plate 204 and the main body 203 of the head cannot be mutually adjoined.

Then, by changing the width B of the liquid path 206 of the main body 203 to 0.035 mm and the lateral width C of the protruding portion 213 of the orifice plate 204 to 0.024 mm while maintaining other parameters unchanged, the condition (2) is satisfied as the left-hand term becomes $5.5\times10^{-3}$ mm and the right-hand term becomes $5.4\times10^{-3}$ mm. Thus the orifice plate 204 and the main body 203 can be securely adjoined even if the dimensions of various parts thereof vary by the environmental temperature change.

As explained in the foregoing, the dimension of the protruding portions 213 of the orifice plate 204 and that of the liquid paths 206 of the main body 203 are subject to certain limitation by the materials constituting these members, and, in certain cases, the conditions (1) and (2) cannot be satisfied unless the gap between the protruding portion 213 and the liquid path 206 is increased, whereby the positional alignment between the main body 203 of the head and the orifice plate 204 shows a large fluctuation. Such situation can be resolved by suitable selection of the materials constituting the orifice plate 204 and the main body 203 of the head.

For example, the orifice plate 204 may be composed of polyimide (such as UPILEX-S (trade name) manufactured by Ube Kosan Co.) having the linear expansion rate b of $1.1\times10^{-5}$ which is smaller than that of polysulfone. Consequently the orifice plate 204 and the main body 203 of the head can be securely adjoined even if the gap between the protruding portion 213 and the liquid path 6 in the direction of array thereof is made smaller than in the case of utilizing polysulfone. More specifically, the width B of the liquid path 206 of the main body 203 is changed to 0.034 mm and the lateral width C of the protruding portion 213 of the orifice plate 204 is changed to 0.032 mm while other parameters remain unchanged, whereby the conditions (1) and (2) are satisfied as, for the condition (1), the left-hand term becomes $1\times10^{-3}$ mm and the right-hand term becomes $0.88\times10^{-3}$ mm, and, for the condition (2), the left-hand term becomes $1\times10^{-3}$ and the right-hand term becomes $8.6\times10^{-7}$ mm. Therefore the orifice plate 204 and the main body 203 of the head can be securely adjoined also under such conditions.

The above-described liquid discharge head provided satisfactory printing without streaks or unevenness therein and without the peeling of the orifice plate. Also the liquid discharge head, when disassembled and observed, proved absence of any undesirable substance in the orifice 212 or in the liquid path 206.

Figure 21:
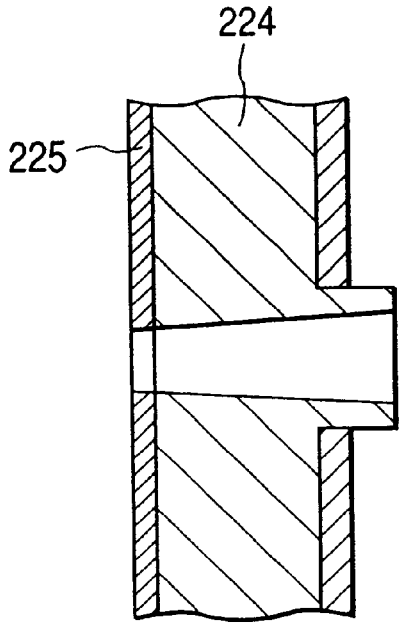
FIG. 21 is a cross-sectional view of an orifice plate subjected to water-repellent treatment on the surface.
Figure 22:
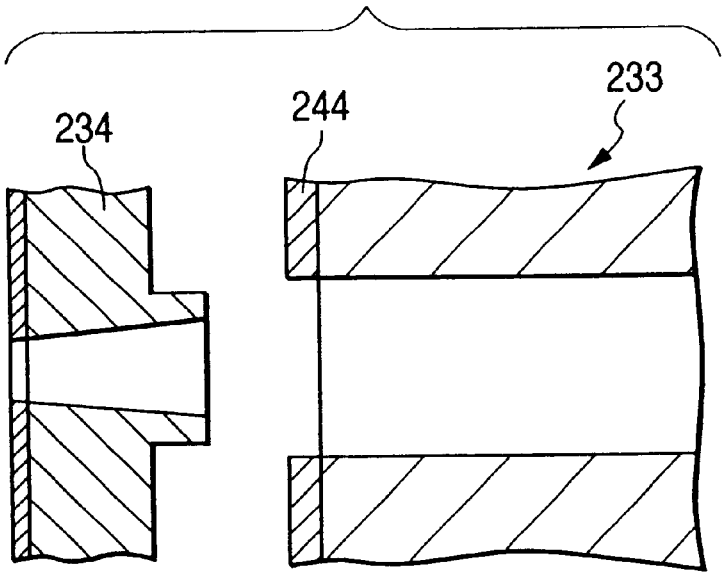
FIG. 22 is a cross-sectional view in a configuration where the adhesive resin is applied to the head main body, prior to the adhesion thereof to the orifice plate.

The foregoing embodiment employed the orifice plate without any surface treatment, but there may also be employed an orifice plate 224 surfacially coated with a water-repelling material 225 as shown in FIG. 21. Such water-repelling treatment on the surface avoids ink deposition onto the surface of the orifice plate 224. Also, as shown in FIG. 22, the adhesive resin 244 for adhering the orifice plate 234 and the main body 233 of the head may be coated on the main body 233 instead of the orifice plate 234. The orifice plate 234 and the main body 233 of the head can be adhered also by coating the adhesive resin 244 on the main body 233, in a similar manner as the case of coating the adhesive resin on the orifice plate 234.

[Ninth Embodiment]

In the foregoing embodiment, the shape of the orifice plate, particularly around the orifice, has to be flat as it significantly influences the direction of liquid discharge. In order to flatly adjoining the flat orifice plate to the main body of the head, the adhesion face of the main body of the head has also to be flat. In practice, however, the head main body usually involves a step difference as shown in FIGS. 25A and 25B as the liquid path is formed by adjoining the ceiling plate and the heater board.

Figure 25A:
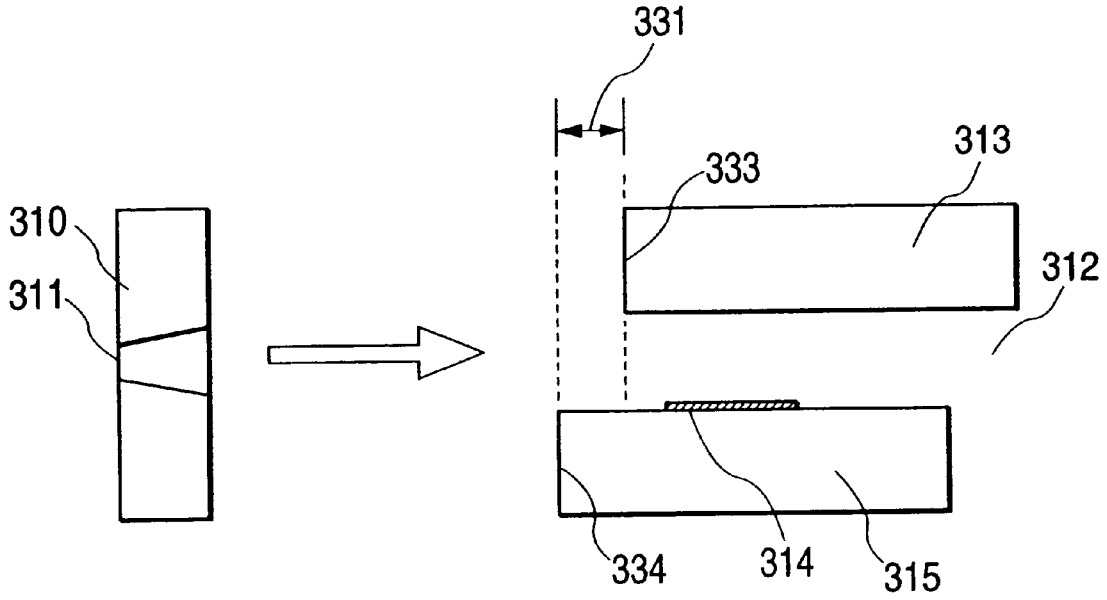
FIGS. 25A and 25B are schematic views showing steps for adhering the orifice plate and the head main body having a stepped portion.
Figure 25B:
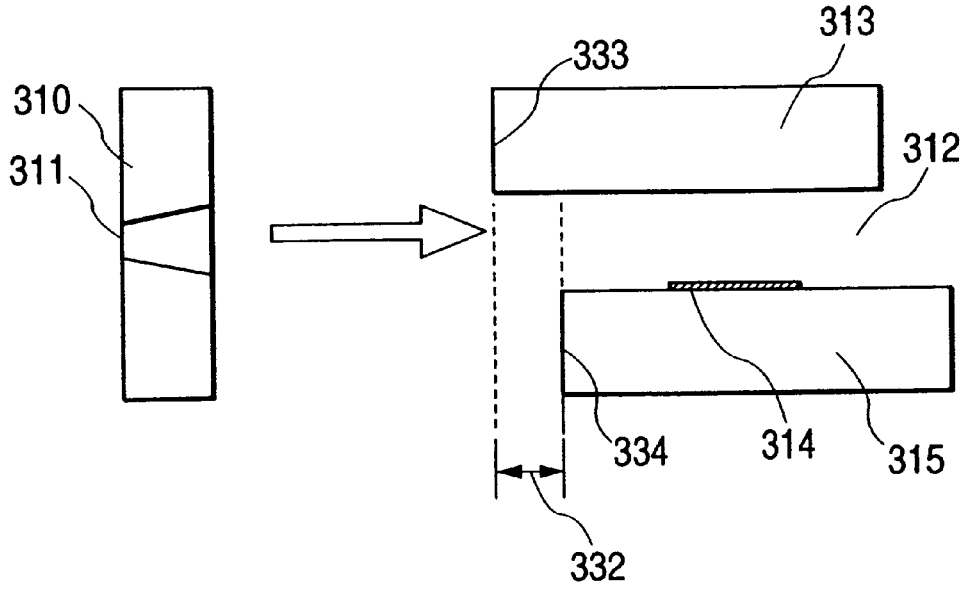

In FIGS. 25A and 25B, there are shown the adhesion face 333 of the ceiling plate and the adhesion face 334 of the heater board, and FIG. 25A shows a step difference 331 in the negative direction while FIG. 25B shows a step difference 332 in the positive direction.

If the orifice plate is adhered to the main body of the head involving such step difference, the orifice plate is deformed by such step difference.

Also in the adjoining of the orifice plate and the main body of the head, in order to achieve close contact in the vicinity of the orifice, the step difference, if present on the adhesion face of the main body, has to be small enough so as to be absorbable for example by the adhesive material.

The coating thickness of the adhesive for adhering the main body of the head and the orifice plate has to be small in order to prevent intrusion of the adhesive into the orifice after the adhering operation, and is 10 to 20 $\mu$m at maximum in the orifice plate having the orifices with a density of 600 dpi.

However, it is extremely difficult to maintain the step difference at 10 $\mu$m or less, and there may be required a polishing operation or the like in order to reduce such step difference.

Also the adhesive material having a thickness less than 10 μm is difficult to provide the sufficient adhesion strength.

In consideration of the foregoing, the present embodiment is to provide a liquid discharge head capable, in adjoining the orifice plate and the head main body having a step difference on the adhesion face, of avoiding deformation of the orifice plate thereby achieving flat adjoining, also of preventing intrusion of the adhesive or sealant into the orifice at the adjoining operation and improving the close contact state around the orifice and the adhesion strength.

More specifically, the liquid discharge head of the present embodiment, formed by adjoining an orifice plate, having a discharge opening for discharging a liquid droplet, to a head main body provided with a liquid path communicating with the discharge opening, a liquid chamber for supplying the liquid path with liquid, a supply aperture for supplying the liquid chamber with the liquid and an energy generating element positioned corresponding to the liquid path and adapted to generate energy to be utilized for liquid discharge:

is featured by a fact that the orifice plate is provided, on the adhesion face with the head main body, with a projection that is deformable by adjoining with the head main body.

The liquid discharge head of the present embodiment is also featured by a fact that the orifice plate has a protruding portion in addition to the projection, that the discharge opening is formed on the protruding portion and that the protruding portion or a part thereof is made to enter the liquid path of the head main body and the projection is simultaneously made to be deformed, whereby the orifice plate is adjoined to the head main body.

In the present embodiment, at the adjoining of the orifice plate with the main body of the liquid discharge head, the above-described configuration allows to prevent deformation of the orifice plate and to achieve flat adjoining thereof even in the presence of a step difference in the adhesion face of the main body, also to prevent intrusion of the adhesive or sealant into the orifice at the adjoining operation, and to improve the close contact around the orifice and the adhesion strength.

In the following the present embodiment will be explained with reference to the attached drawings.

Figures 1, 23A:
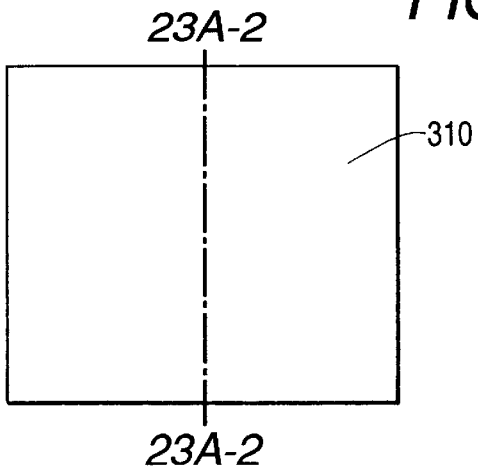
Figures 2, 23A:
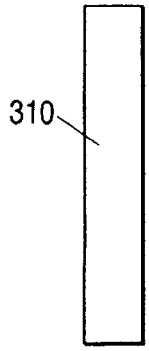
Figures 1, 23B:
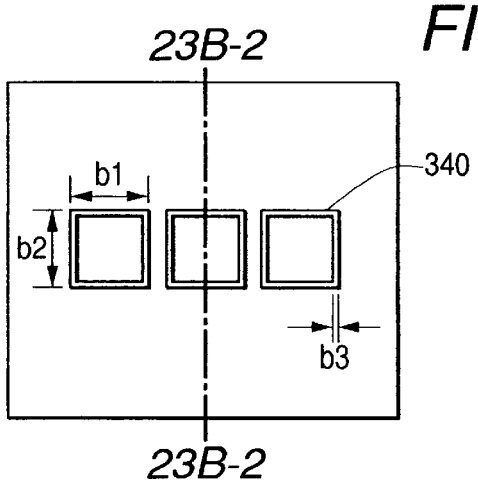
Figures 2, 23B:
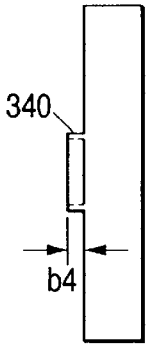
Figures 1, 23C:
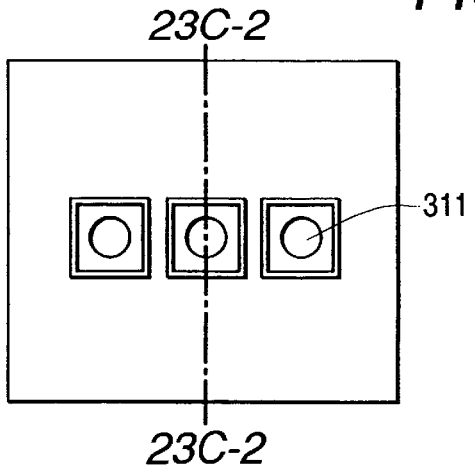
Figures 2, 23C:
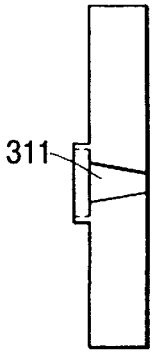

FIGS. 23A to 23C are views illustrating the orifice plate of the present embodiment.

In the present embodiment, the orifice plate was composed of a PSF film of a thickness of 50 μm (FIG. 23A). Photosensitive resin was coated on the orifice plate and subjected to exposure and development to form a projection 340 as shown in FIG. 23B.

Such projection may however be also formed by another method such as laser working on resin.

Then the orifice was formed by the apparatus shown in FIG. 9, employing the KrF excimer laser beam.

At first the projections 340 were formed with photosensitive resin in such a manner that the pattern shown in FIG. 23B is linearly repeated in plural units with a pitch of 600 dpi.

The projection had a width b3 of 2 μm and a height b4 of 10 μm, and widths b1, b2 of 32 μm.

Then the excimer laser beam was irradiated from the side of the adhesion face of the orifice plate with the main body of the head, to form the orifice 311 of a diameter of 22 μm in each projection (FIG. 23C).

In the following there will be briefly explained the configuration of the liquid discharge head of the present embodiment.

The liquid discharge head is constituted, as shown in FIG. 1, by adjoining the ceiling plate, integrally provided with the liquid chamber frame and the liquid path walls for forming the liquid paths and the liquid chamber, with the substrate (heater board) on which the energy generating elements (heaters) for generating the discharge energy and the Al wirings for supplying the heaters with electrical signals are formed by the film forming technology.

The working method for the ceiling plate will not be explained since there have been proposed various methods such as a method of forming the liquid paths and the liquid chamber by etching a silicon substrate, or a method of forming the liquid paths and the liquid chamber by laser working or molding of resinous material.

At first, the main body of the head is formed by adjoining the heater board and the ceiling plate having the liquid chamber frame and the liquid path walls.

In the present embodiment, the liquid chamber frame and the liquid path walls for forming the liquid chamber and the liquid paths are formed on the ceiling plate, but the present invention is effective also in the head of a configuration where these members are formed on the heater board.

The method of forming the liquid chamber frame and the liquid path walls on the heater board will not be explained in detail, since there have been proposed various method, such as a method of forming these members by exposure and development of photosensitive resin.

Then, on the aperture face having the aperture of the liquid path formed for each unit (namely the adhesion face of the main body of the head), the orifice plate is adhered for example with an adhesive material.

In the present embodiment, the step difference (FIGS. 25A and 25B) in the adjoining between the ceiling plate and the heater board may be present if such step difference or precision of adjoining does not exceed dl+b4 wherein b4 is the height of the projection (FIGS. 23A to 23C) and dl is the thickness of the adhesive material coated on the adhesion face of the main body.

Then an epoxy adhesive 322, which is shifted to the B-stage to complete shrinkage by UV irradiation while maintaining the tackiness and which can thereafter be adhered by heating and pressing, is uniformly coated with a thickness of 2 μm (d1) by the transfer method onto the main body of the head.

Then the adhesive material is shifted to the B-stage with shrinkage, by ultraviolet irradiation of 1 $mW/cm^2$ for 60 seconds.

Figure 24A:
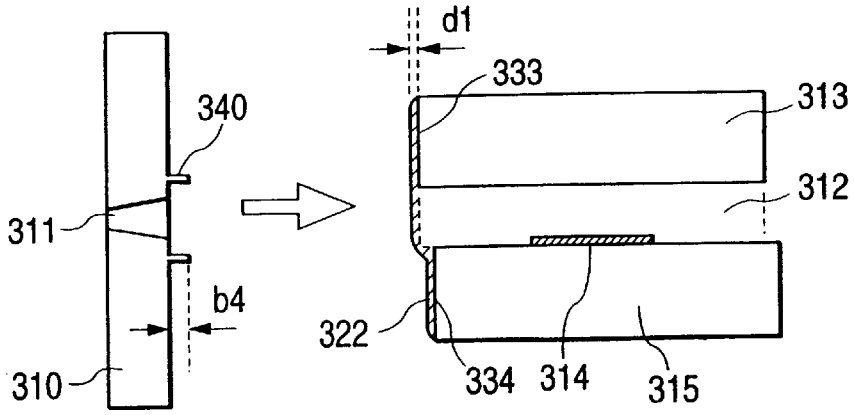
FIGS. 24A, 24B, 24C are schemetic cross-sectional views showing steps of adhesion of the orfice plate and the head main body in the ninth embodiment of the present invention.
Figure 24B:
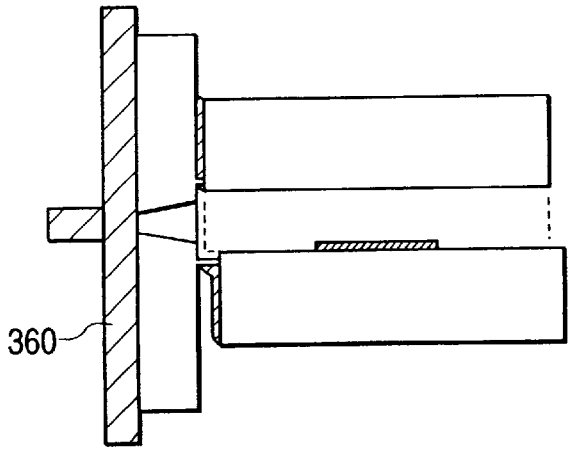
Figure 24C:
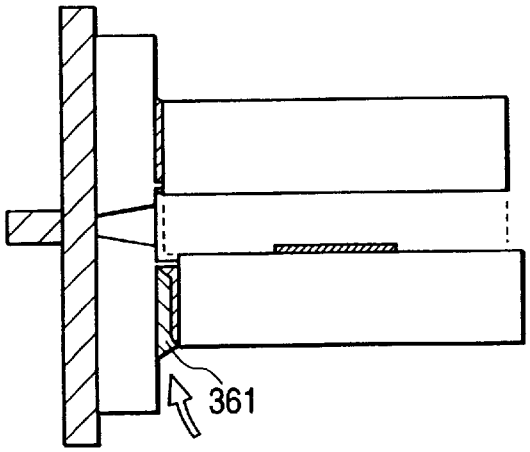

Then the head main body, formed by adjoining the heater board and the ceiling plate with the above-mentioned precision, is aligned with the orifice and adhered as shown in FIGS. 24A to 24C.

Subsequently a pressure of 1 $kg/cm^2$ is applied by a flat pressing plate 360 placed on the orifice face in parallel to the adhesion face 333 of the main body to crush the projection, whereby the projections 340 of the orifice plate are maintained in close contact with the adhesion face 334 at the heater board side and that 333 at the ceiling plate side. Heating is conducted at 60° C. in such pressed state to complete the hardening of the adhesive. Then silicone sealant 361 is introduced, as shown in FIG. 24C, into the gap formed by the step difference between the adhesion face of the heater board side and the orifice plate, and is hardened by standing for 2 hours at the room temperature.

The liquid discharge head after the adhesive hardening provided satisfactory printing without streaks or unevenness therein and without the peeling of the orifice plate.

Also the observation of the adhesion state of the main body of the head and the orifice plate proved that the adhesion face of the ceiling plate side was in close contact with the orifice plate across the adhesive material, and that the adhesion face of the heater board side was in close contact by crushing of the ends of the projections by the applied weight. Consequently the sealant was stopped at the projection and did not reach the orifice.

Also since the flat pressing plate was used to apply the pressure parallel to the heater board, thus controlling the crushed amount of the projections, the projections worked as pillars supporting the orifice plate thereby preventing the deformation of the orifice plate itself.

Also the use of the sealant significantly improved the adhesion strength.

The foregoing embodiment has been explained by the case of a step difference at the positive side as shown in FIGS. 24A to 24C, but the present invention is likewise effective also in case of a step different at the negative side.

[Tenth Embodiment]

Figures 1, 26A:
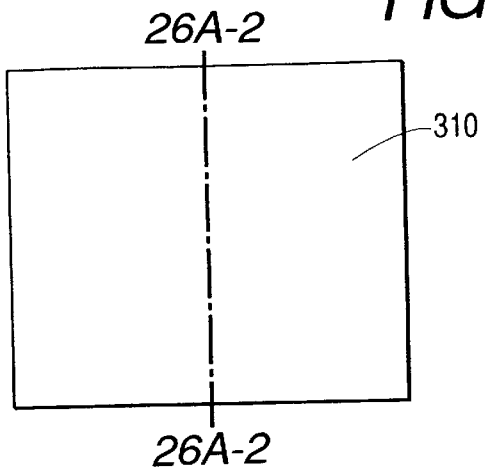
Figures 2, 26A:
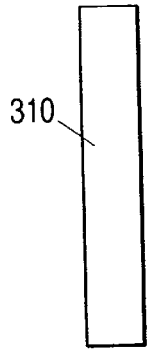
Figures 1, 26B:
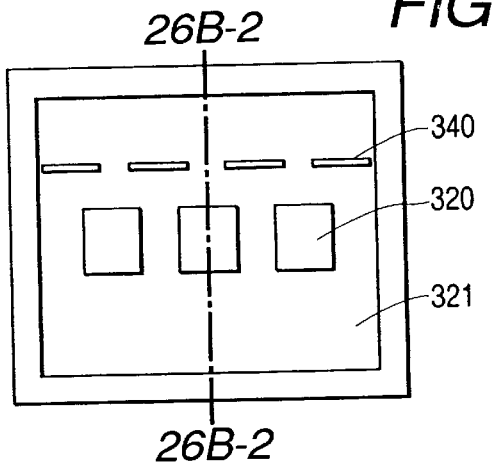
Figures 2, 26B:
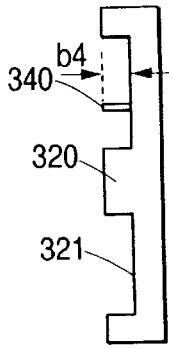
Figures 2, 26C:
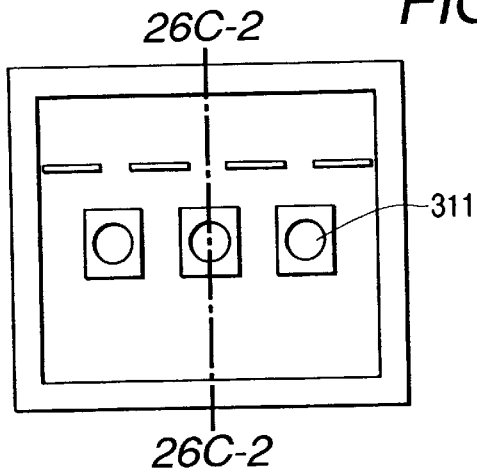
Figures 2, 26C:
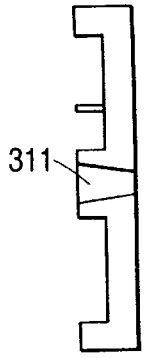

FIGS. 26A to 26C are views showing the orifice plate in the present embodiment.

In the present embodiment, the orifice plate is composed of a PSF film of a thickness of 50 $\mu$m (FIG. 26A), and the protruding portion, projection and orifice are formed by the KrF excimer laser beam, utilizing the apparatus shown in FIG. 9.

There are shown an excimer laser 350, a laser beam 352, a lens 351 for condensing the laser beam emitted from the excimer laser, a mask 353 positioned between the excimer laser and the orifice plate, and an orifice plate 310 on which the protruding portion, projection and orifice are to be formed.

At first a recess 321 is formed in such a manner that protruding portions 320 are linearly arranged in plural units at a pitch of 600 dpi and that projections 340 are formed in an area around the protruding portions and adapted to be adjoined to the main body of the head (FIG. 26B).

On the orifice plate, the protruding portion had a dimension of 30 $\mu$m×30 $\mu$m, and the recess was formed with a depth of 15 $\mu$m excluding the protruding portions and the projections, in such a manner that the projections of a width of 2 $\mu$m were formed in a position distanced by 30 $\mu$m from the protruding portions.

Then the excimer laser beam was irradiated from the side of the adhesion face of the orifice plate with the main body of the head to form an orifice of a diameter of 22 $\mu$m in each protruding portion (FIG. 26C).

In the present embodiment, the protruding portion and the projection are formed at first and the orifice is formed later, but it is also possible to form the orifice at first and then to form the protruding portion and the projection afterwards.

Subsequently the main body of the head is obtained by adjoining the heater board and the ceiling plate provided integrally with the liquid chamber frame and the liquid path walls, as in the fourth embodiment.

Figure 27A:
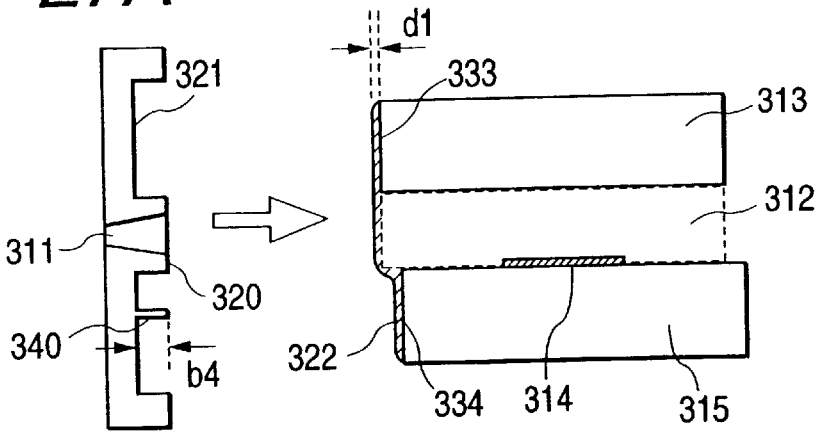
FIGS. 27A, 27B and 27C are schematic cross-sectional views showing steps of adhesion of the orifice plate and the head main body in the tenth embodiment of the present invention.
Figure 27B:
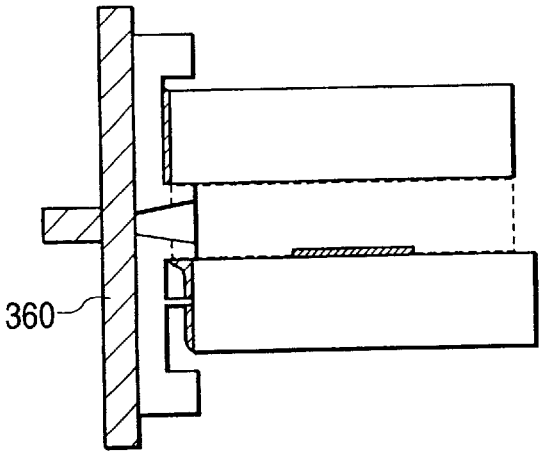
Figure 27C:
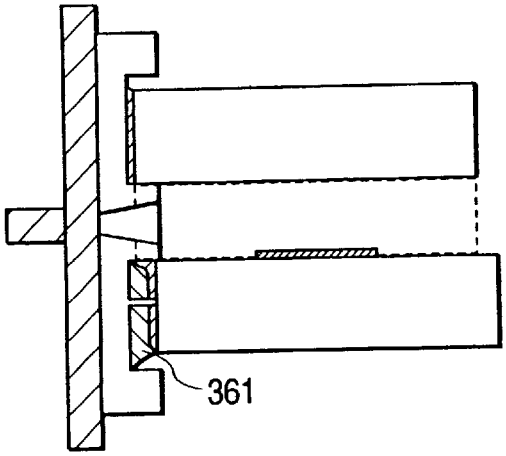

In the present invention, the step difference or the precision of adhesion between the ceiling plate and the heater board may be present in such a manner that the adhesion face of the ceiling plate is positioned within a range from dl in the negative direction to b4 in the positive direction with respect to the adhesion face of the heater board, wherein dl is the thickness of the adhesive coated on the adhesion face of the main body of the head while b4 is the height of the projection (FIGS. 27A to 27C).

Then an epoxy adhesive 322, which is shifted to the B-stage to complete shrinkage by UV irradiation while maintaining the tackiness and which can thereafter be adhered by heating and pressing, is uniformly coated with a thickness of 2 $\mu$m (d1) by the transfer method onto the main body of the head.

Then the adhesive material is shifted to the B-stage with shrinkage, by ultraviolet irradiation of 1 mW/cm$^2$ for 60 seconds.

Then the protruding portion formed around the orifice is made to proceed toward the head main body, formed by adjoining the heater board and the ceiling plate with the above-mentioned precision, and is adhered, as shown in FIG. 27B.

Subsequently a pressure of 1 kg/cm$^2$ is applied by a flat pressing plate placed on the orifice face in parallel to the adhesion face of the ceiling plate side to bring the adhesion face of the ceiling plate side and the recess of the orifice plate in close contact, and heating is conducted at 60° C. in such pressed state to complete the hardening of the adhesive.

Then silicone sealant is introduced, as shown in FIG. 27C, into the gap formed by the step difference between the ceiling plate and the adhesion face of the orifice plate side, and is hardened by standing for 2 hours at the room temperature.

The liquid discharge head after the adhesive hardening provided satisfactory printing without streaks or unevenness therein and without the peeling of the orifice plate.

Also the observation of the adhesion state of the main body of the head and the orifice plate proved that the flat pressing plate was used to apply the pressure parallel to the heater board, thus controlling the crushed amount of the projections, so that the projections worked as pillars thereby preventing the deformation of the orifice plate itself.

Also the observation of the adhesion state of the head main body and the orifice plate proved that the adhesion face of the ceiling plate side was in complete contact by the adhesive and that the adhesion face of the heater board side was in close contact by the sealant.

Also the use of the sealant significantly improved the adhesion strength.

Also there was no intrusion of the adhesive or sealant in the orifice and in the liquid path.

The foregoing embodiment has been explained by a case where the liquid path walls are formed on the ceiling plate, but they may also be formed on the heater board.

In such case, the adhesion face of the heater board side contacts the orifice plate by the adhesive material, and that of the ceiling plate side contact the orifice plate by deforming the projections.

More specifically, in the adjoining of the ceiling plate and the heater board, the step difference or the precision of adjoining may be present in such a manner that the adhesion face of the ceiling plate is positioned within a range from dl in the negative direction to b4 in the positive direction with respect to the adhesion face of the heater board, and the effect of the present invention can be likewise obtained if the step difference is within such range.

Figures 1, 28A:
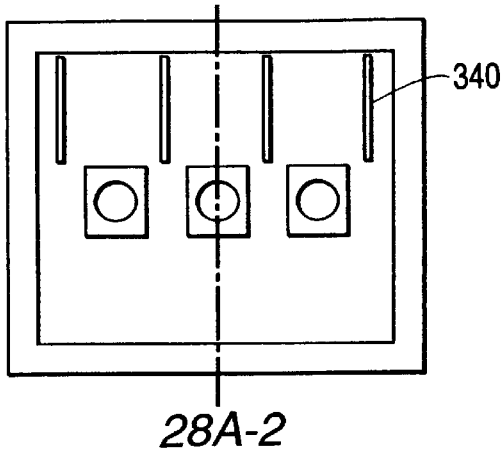
Figures 2, 28A:
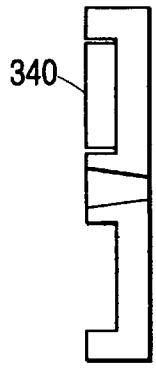
Figures 1, 28B:
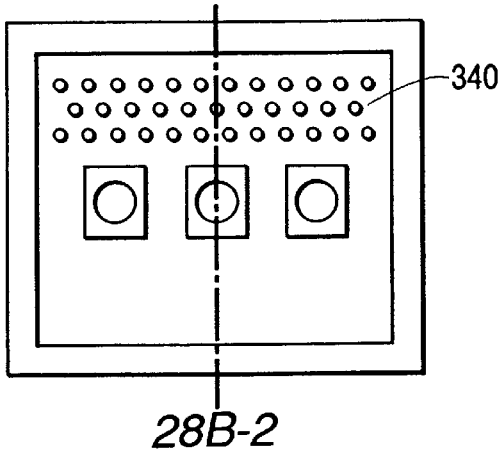
Figures 2, 28B:
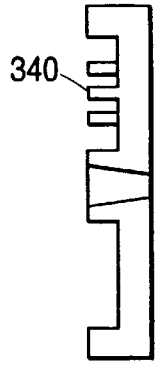
Figures 1, 28C:
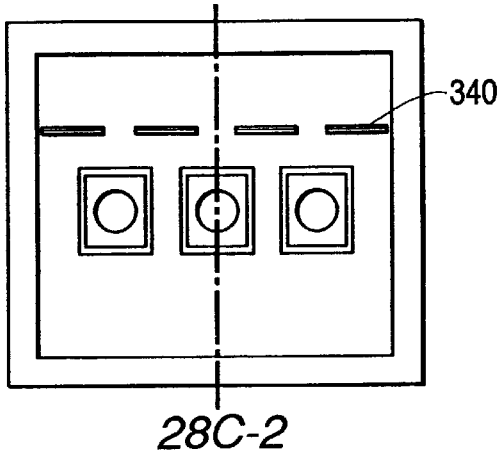
Figures 2, 28C:
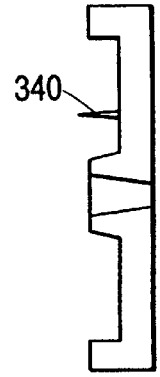

In addition to the embodiment described above, the projection may be provided with a pattern (circle, rectangle or tetragon) as shown in FIGS. 8A to 8C, or the external periphery of the protruding portion or projection on the orifice plate may have a tapered shape as shown in FIG. 28C.

[Eleventh Embodiment]

Figures 1, 29A:
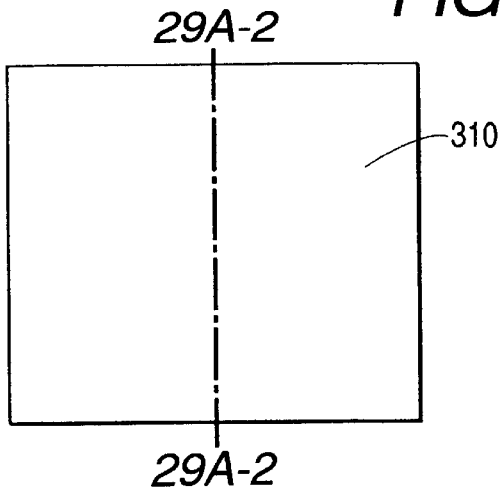
Figures 2, 29A:
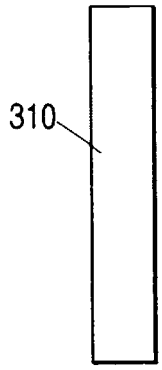
Figures 1, 29B:
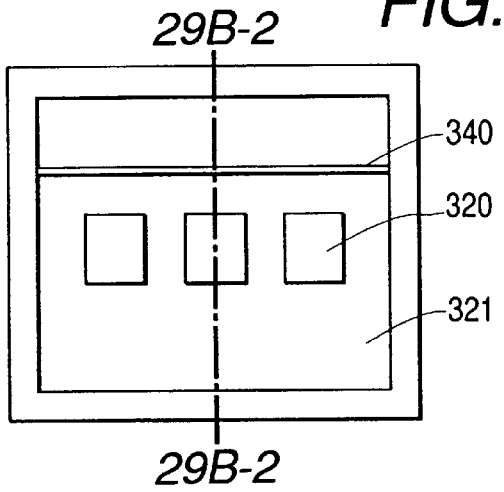
Figures 2, 29B:
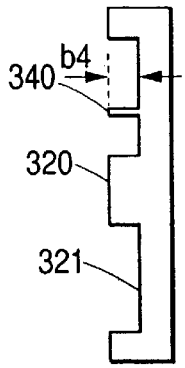
Figures 1, 29C:
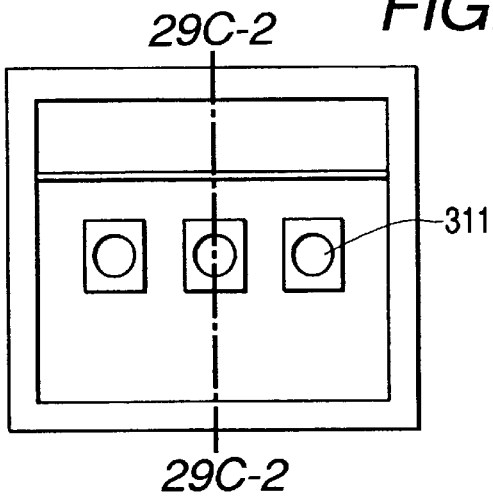
Figures 2, 29C:
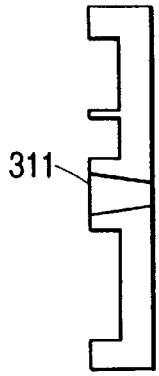

FIG. 29A to 29C are views showing the orifice plate of an eleventh embodiment.

In case of adjoining the orifice plate and the main body of the head as in the tenth embodiment, the configuration of the present embodiment prevents the entry of the sealant into the orifice.

In the configuration of aligning the orifice plate, provided with a protruding portion and a recessed portion, with the liquid path of the head main body, causing the protruding portion provided around the orifice to enter the liquid path of the head main body, adjoining the adhesion face of the main body by adhesive material in the recessed portion and introducing sealant or the like into the gap for achieving close contact, there has to be employed sealant of low viscosity in a large amount in order to sufficiently deliver the sealant to the adhesion face, and such sealant may eventually enter the liquid path or the interior of the orifice in case the dimension of the protruding portion is significantly different from that of the aperture of the liquid path. However, according to the present embodiment, the projection and the adhesion face at the heater board side are in close contact to prevent the sealant from reaching the orifice.

In the present embodiment, the orifice plate is composed, as in the tenth embodiment, of a PSF film of a thickness of 50 $\mu$m, and the protruding and recessed portions, projection and orifice are formed by the KrF excimer laser beam, utilizing the apparatus shown in FIG. 9.

On the orifice plate, the protruding portion 320 had a dimension of 30×30 $\mu$m, and the recess 321 was formed with a depth of 15 $\mu$m excluding the protruding portions and the projections, in such a manner that the projections of a width of 2 $\mu$m were formed in a position distanced by 30 $\mu$m from the protruding portions.

Then the excimer laser beam was irradiated from the side of the adhesion face of the orifice plate with the main body of the head to form an orifice of a diameter of 22 $\mu$m in each protruding portion.

In the present embodiment, the protruding portion and the projection are formed at first and the orifice is formed later, but it is also possible to form the orifice at first and then to form the protruding portion and the projection afterwards.

Subsequently, the main body of the head is obtained by adjoining the heater board and the ceiling plate provided integrally with the liquid chamber frame and the liquid path walls, as in the tenth embodiment.

In the present invention, the tolerance of the step difference or the precision of adhesion between the ceiling plate and the heater board is such that the adhesion face of the ceiling plate is positioned within a range from dl in the negative direction to b4 in the positive direction with respect to the adhesion face of the heater board, wherein dl is the thickness of the adhesive material coated on the adhesion face of the main body of the head while b4 is the height of the projection.

Then an epoxy adhesive, which is shifted to the B-stage to complete shrinkage by UV irradiation while maintaining the tackiness and which can thereafter be adhered by heating and pressing, is uniformly coated with a thickness of 2 $\mu$m (d1) by the transfer method onto the main body of the head.

Then the adhesive material is shifted to the B-stage with shrinkage, by ultraviolet irradiation of 1 mW/cm$^2$ for 60 seconds.

Then the protruding portion formed around the orifice is made to proceed toward the head main body, formed by adjoining the heater board and the ceiling plate with the above-mentioned precision, and is adhered.

Subsequently a pressure of 1 kg/cm$^2$ is applied by a flat pressing plate placed on the orifice face in parallel to the adhesion face of the ceiling plate side to bring the adhesion face of the ceiling plate side and the recess of the orifice plate in close contact, and heating is conducted at 60° C. in such pressed state to complete the hardening of the adhesive.

Then silicone sealant is introduced into the gap formed by the step difference between the ceiling plate and the adhesion face of the orifice plate side, and is hardened by standing for 2 hours at the room temperature.

The liquid discharge head after the adhesive hardening provided satisfactory printing without streaks of unevenness therein and without the peeling of the orifice plate.

Also the observation of the adhesion state of the main body of the head and the orifice plate proved that the adhesion face at the ceiling plate side was in close contact state with the adhesive, and that the adhesion face at the heater board side was in close contact, where the ends of the projections were crushed by the applied pressure and supported by the adhesive.

In order to sufficiently deliver the sealant over the adhesion face, there has to be employed sealant of low viscosity in a large amount.

Also the protruding portion around the orifice, introduced into the liquid path, may not be in close contact therewith, showing a gap thereto.

Even in such situation, however, the configuration of the present embodiment prevents the sealant from reaching the orifice, since the projection and the adhesion face of the heater board side are in close contact.

Also since the flat pressing plate was used to apply the pressure parallel to the heater board, thus controlling the crushed amount of the projections, the projections worked as pillars supporting the orifice plate thereby preventing the deformation of the orifice plate itself.

Also the use of the sealant significantly improved the adhesion strength.

The foregoing embodiment has been explained by a case where the liquid path walls are formed on the ceiling plate, but they may also be formed on the heater board.

In such case, the adhesion face of the heater board side contacts the orifice plate by the adhesive material, and that of the ceiling plate side contact the orifice plate by deforming the projections.

More specifically, in the adjoining of the ceiling plate and the heater board, the tolerance for the step difference or the precision of adjoining is such that the adhesion face of the ceiling plate is positioned within a range from dl in the negative direction to b4 in the positive direction with respect to the adhesion face of the heater board and the effect of the present invention can be likewise obtained if the step difference is within such range.

[Twelfth Embodiment]

The present embodiment related to a configuration of the liquid discharge head and a producing method therefor, capable of suppressing the aforementioned step difference on the orifice plate, preventing the entry of the adhesive, suppressing the cost of the manufacturing apparatus, being mass produced and showing high reliability.

The liquid discharge head of the present embodiment including an orifice plate provided with plural discharge openings for discharging liquid droplets and a head main body provided at least with plural liquid paths respectively corresponding to the plural discharge openings, and being formed by adjoining the orifice plate with the head main body in such a manner that the discharge openings communicate with the liquid paths, wherein, within the adhesion face of the head main body with the orifice plate, a portion corresponding to the liquid path protrudes more than in other areas and such protruding portion is adjoined with the adhesion face of the orifice plate.

The above-mentioned head main body is constituted by adjoining an element substrate and a ceiling substrate, wherein the ceiling substrate is provided with a supply aperture for liquid supply to the liquid paths while the element substrate is provided with plural liquid path walls for forming the plural liquid paths upon adjoining with the ceiling substrate and plural energy generating elements respectively positioned between the liquid path walls for generating energy for liquid droplet discharge.

The above-described liquid discharge head allows secure adhesion in the area around the discharge opening where the most stable adhesion is required, whereby it is rendered possible to prevent entry of the adhesive resin into the liquid path and the bubble inclusion in the adhesive resin.

According to the present invention, there is also provided a method for producing the liquid discharge head including a head main body formed by adjoining an element substrate provided with plural energy generating elements for generating energy for liquid droplet discharge and plural liquid path walls for forming plural liquid paths in which the energy generating elements are respectively provided, and a ceiling substrate provided with a supply aperture for liquid supply to the liquid paths thereby forming the liquid paths, and an orifice plate adjoined to the head main body and provided with plural discharge openings for discharging liquid droplets, the method comprising a step of inclining the adhesion face of the ceiling substrate with the orifice plate in such a manner that, within the adhesion face of the element substrate with the orifice plate, a ridge at the side of the energy generating elements protrudes; a step of preparing the head main body by aligning the protruding ridge of the adhesion face of the element substrate with the orifice plate and the protruding ridge of the adhesion face of the ceiling substrate with the orifice plate on a substantially same plane and adjoining the element substrate and the ceiling substrate; and a step of adjoining the orifice plate to the head main body in such a manner that the discharge openings and the liquid paths mutually communicate.

In such method, the step of inclining the adhesion face of the element substrate with the orifice plate and the step of inclining the adhesion face of the ceiling plate with the orifice plate are steps of diagonally cutting the element substrate and the ceiling substrate, and the method is featured by a fact that the cutting is executed with a diamond blade.

In the above-mentioned protruding method for the liquid discharge head, the head main body is constituted by the element substrate provided with the plural energy generating elements for generating energy for liquid droplet discharge and the plural liquid path walls for forming plural liquid paths in which the energy generating elements are respectively provided, and the ceiling substrate provided with the supply aperture for liquid supply to the liquid paths, and, in cutting each substrate, there is employed an apparatus to obtain an inclined cut face in such a manner that the ridge of the element bearing face of the element substrate at the orifice plate adhesion face and the ridge of the element substrate adhesion face of the ceiling substrate at the orifice plate adhesion face respectively protrude from the ridge at the opposite face, and the head main body is prepared by adjoining by mutually abutting the protruding ridges. Such preparing method allows to minimize the step difference on the adhesion face of the orifice plate, caused by small positional aberration in the adjoining of the ceiling substrate and the element substrate. Therefore, in the configuration of forming the protruding portion around the liquid discharge opening, corresponding to the cross sectional shape of the liquid path, and inserting such protruding portion or a part thereof into the liquid path, there can be achieved secure entry of the protruding portion into the liquid path and secure adjoining in the area close to the discharge opening where the most stable adjoining is required. It is therefore rendered possible to prevent the entry of adhesive resin into the liquid path and the bubble inclusion in the adhesive resin.

Also, as the orifice formation can be executed prior to the adjoining to the head main body, there can be prevented intrusion of dusts, generated by laser ablation, into the liquid path. The present embodiment can also significantly reduce the aberration of the orifice, resulting from the difference in the thermal expansion coefficient when the orifice plate and the head main body are heated to a high temperature.

According to the present invention, there is also provided a method for producing the liquid discharge head including a head main body formed by adjoining an element substrate provided with plural energy generating elements for generating energy for liquid droplet discharge and plural liquid path walls for forming plural liquid paths in which the energy generating elements are respectively provided, and a ceiling substrate provided with a supply aperture for liquid supply to the liquid paths thereby forming the liquid paths, and an orifice plate adjoined to the head main body and provided with plural discharge openings for discharging liquid droplets, the method comprising a step of adjoining a semiconductor wafer bearing a plurality of the element substrates and a semiconductor wafer bearing a plurality of the ceiling substrates thereby forming an adjoined member; a step of forming a notch with a first diamond blade on the ceiling substrate of the adjoined member; a step of inverting the adjoined member and forming a notch with the first diamond blade on the element substrate of the adjoined member; a step of cutting the remainder of cutting of the adjoined member with the first diamond blade, with a second diamond blade narrower in width than the first diamond blade thereby forming the head main body; and adjoining the orifice plate to the head main body in such a manner that the discharge openings respectively communicate with the liquid paths.

In such producing method, the semiconductor wafer bearing a plurality of the element substrates and the semiconductor wafer bearing a plurality of the ceiling substrates are mutually adjoined so as to form the liquid paths, thereby forming an adjoined member, which is then out into the head main body, whereby the adhesion face of the head main body with the orifice plate is free from the step difference so that no crosstalk is generated between the neighboring nozzles after the adjoining of the orifice plate. Also, in preparing the head main body, notches are formed with the first diamond blade of a larger width in succession on the element substrate and the ceiling substrate of the adjoined member, and the remainder of cutting is cut with the second diamond blade thinner than the first diamond blade, whereby the amount of wafer cutting with the diamond blade is limited so that the diamond blade of a smaller width can be employed to improve the productivity.

In the following, the present embodiment will be clarified further with reference to the attached drawings.

Figure 30:
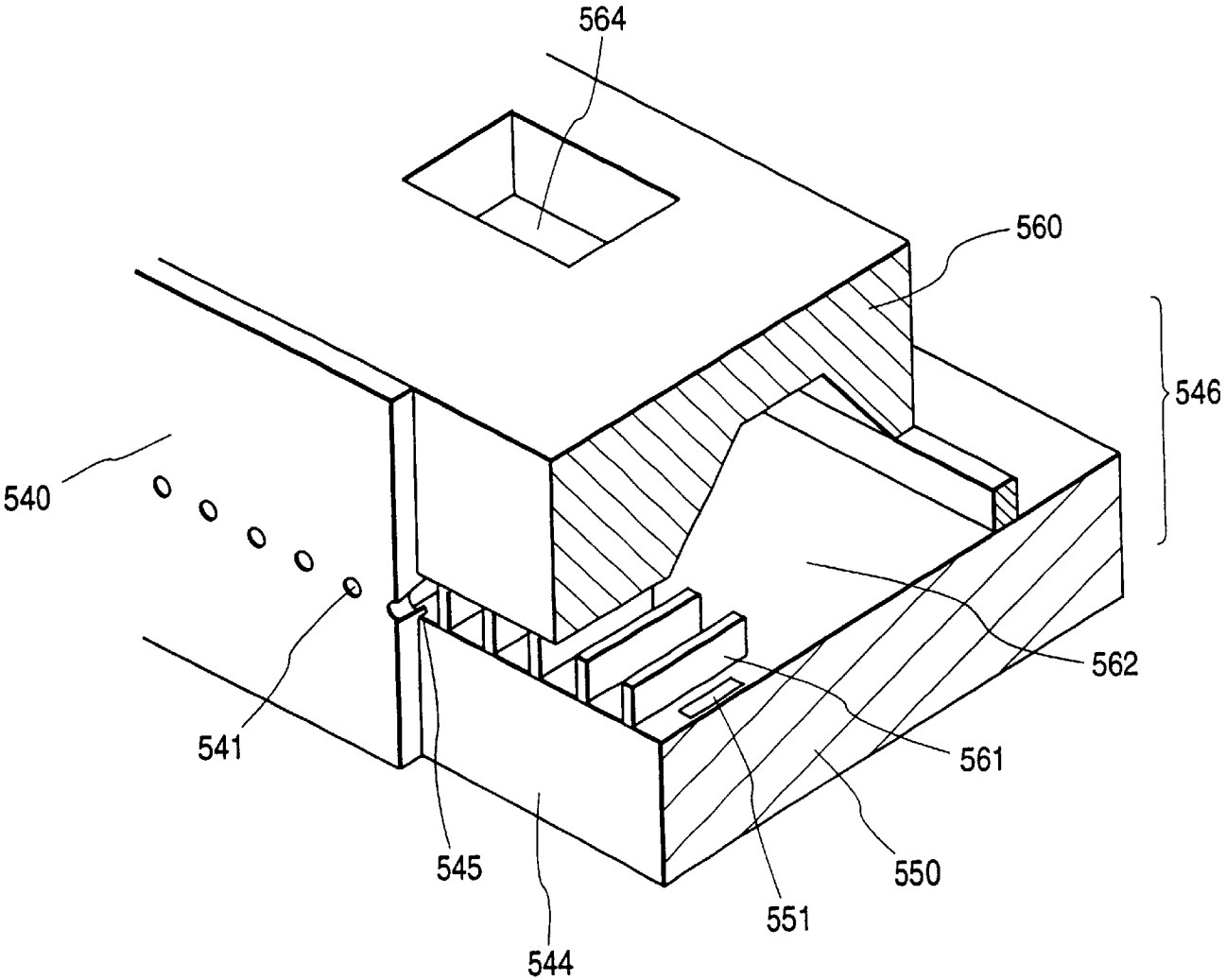
FIG. 30 is a schematic perspective view showing the configuration of the liquid discharge head in a twelfth embodiment of the present invention.
Figure 31:
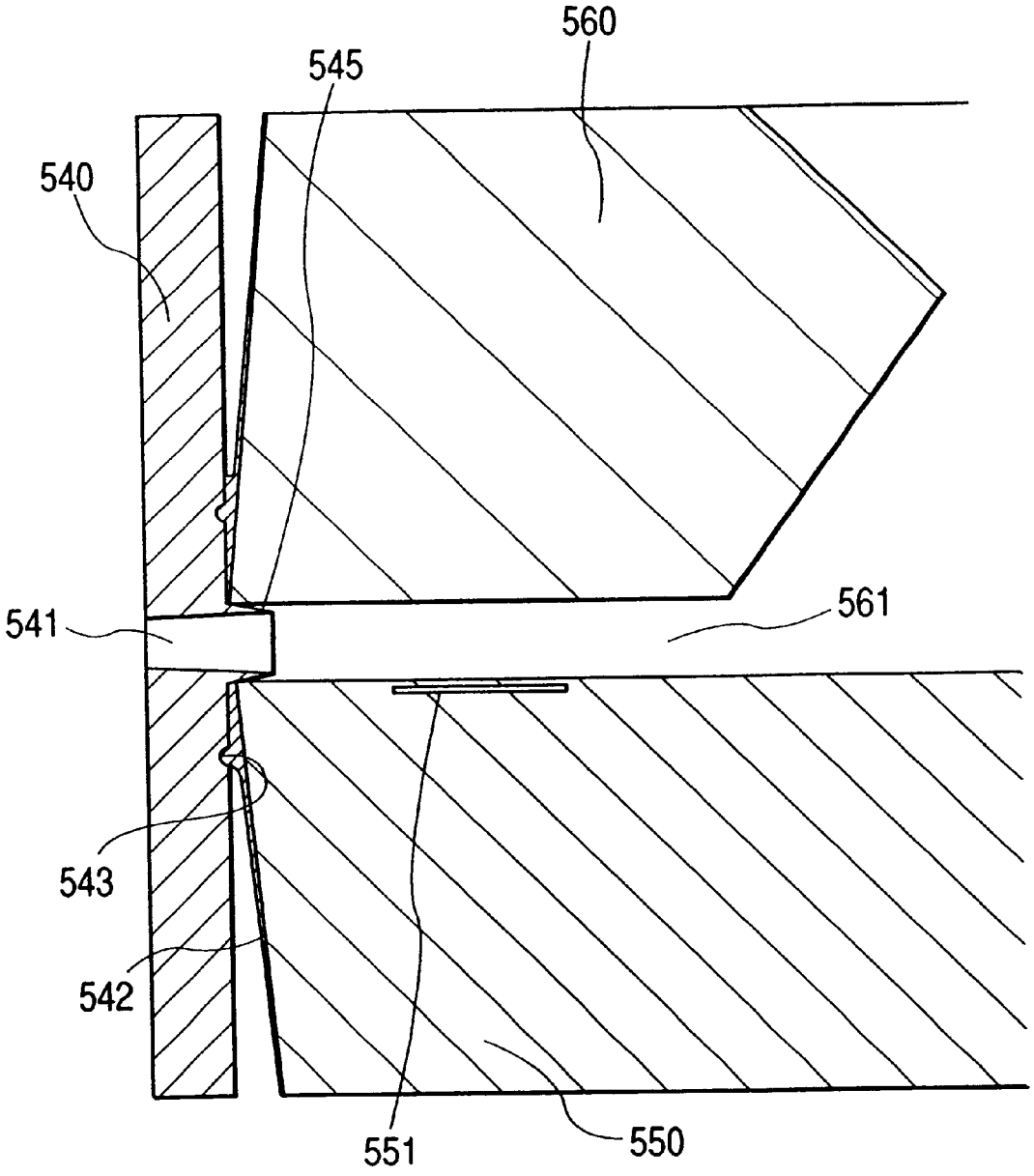
FIG. 31 is a schematic cross-sectional view showing the features of the liquid discharge head of the twelfth embodiment of the present invention.

FIG. 30 is a schematic perspective view of the liquid discharge head of the twelfth embodiment, and FIG. 31 is a schematic cross-sectional view best showing the features of the liquid discharge head thereof.

The liquid discharge head shown in FIGS. 30 and 31 is provided with a main body 546, constituted by adjoining a ceiling substrate 560 bearing step differences for forming a liquid chamber 562, and an element substrate 550 on which provided are energy generating elements (heaters) 551 for generating discharge energy, and Al wirings for supplying electrical signals thereto, both being formed by a film forming technology on an Si substrate, and on which also provided are liquid path walls for constituting the ink paths 561 respectively corresponding to the heaters 551. An orifice plate 540 is adjoined to a face (adhesion face 544) on which arranged are the apertures of the liquid paths 561, formed by the above-mentioned adjoining. Around the discharge opening 541 of the orifice plate 540, there is formed a protruding portion 545 capable of entering the liquid path 561, constituted by adjoining the ceiling substrate 560 and the element substrate 550, and the protruding portion 545 is inserted into the liquid path 561 of the head main body when the orifice plate 540 is adhered to the head main body (FIG. 31).

The orifice plate 540 is preferably composed of a metal film such as of stainless steel or Ni, or a plastic film of satisfactory ink resistance, such as of polyimide, polysulfone, polyethersulfone, polyphenylene oxide, polyphenylene sulfide or polypropylene.

In the following there will be briefly explained the method for producing the head main body. The ceiling substrate 560 and the element substrate 550 are respectively cut in advance in such a manner that the ridges, within the adhesion face 544 of the substrates 550, 560 with the orifice plate, protrude more at the face of mutual adjoining of both substrates than the ridges at the opposite faces, and the substrates 550, 560 are mutually adjoined under abutting alignment of the protruding ridges, thereby forming the head main body 546. Then adhesive material 542 extended in advance is transferred onto the adhesion face 544 of the orifice plate of the main body 546. The adhesive material 542 was composed of epoxy adhesive of cationic polymerization type, which could be shifted to the B-stage with completed shrinkage while retaining the tackiness under UV irradiation, and which could be hardened by further ultraviolet irradiation or by heating. The adhesive could achieve adhesion also by heating and pressing only.

The head main body 546 and the orifice plate 540 are adjoined with such adhesive material 542. Around the orifices of the orifice plate 540, there are formed protruding portions 545 of a shape matching the cross sectional shape of the liquid paths, along the direction of array of the liquid paths, and such protruding portions 545 enter the liquid paths 561. In such configuration, the protruding portion 545 limits the positional aberration between the orifice (discharge opening) 541 and the liquid path 561 generated in the hardening step of the adhesive material or by the temperature change when the heater is activated. Also the adhesive 542 attached to the adhesion face 544 is in close contact with the peripheral area of the protruding portion 545 of the orifice plate 540, and the orifice plate 540 and the head main body are adjoined in such peripheral area. The peripheral area is provided with a groove 543 for receiving the adhesive material 542 to improve the adhesion strength between the orifice plate 540 and the head main body.

In the present embodiment, the orifice plate was composed of a PSF film of a thickness of 50 $\mu$m.

As explained in the foregoing, the ridges, within the adhesion face 544 of the substrates 550, 560, are made to protrude more at the mutually adjoined face than the ridges on the opposite faces, thereby minimizing the step difference on the adhesion face of the orifice plate caused by the small positional aberration in the adjoining of the ceiling substrate 560 and the element substrate 550, also achieving secure entry of the protruding portion 545 into the liquid path 561 and achieving secure adjoining in the vicinity of the discharge opening 541 where the most stable adjoining is required.

In the following there will be explained an example of the cutting operation of the ceiling substrate 560 and the element substrate 550, with reference to FIG. 32.

Figure 32:
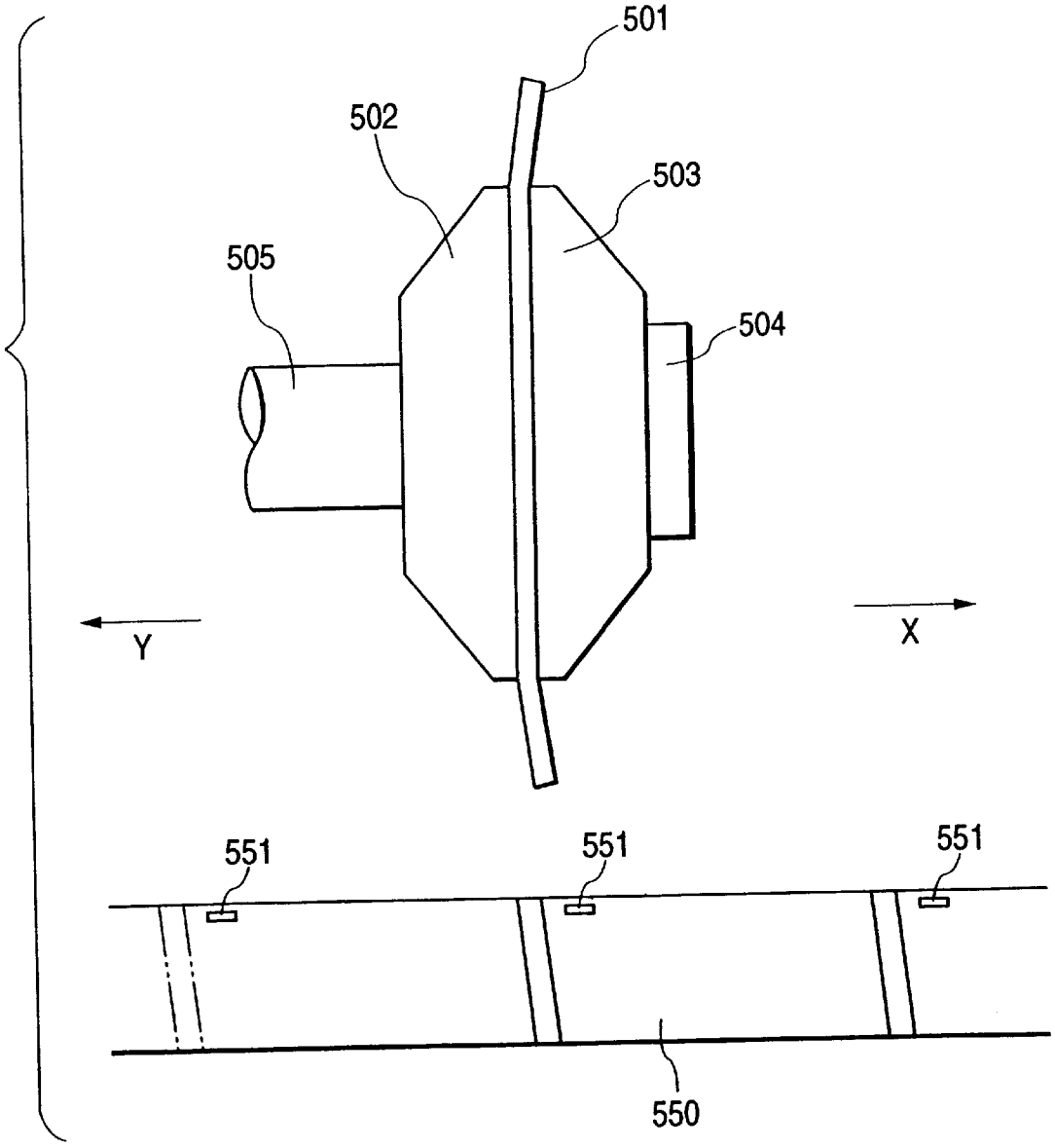
FIG. 32 is a schematic view of a diamond blade and a fixing flange unit therefor in a dicing machine for the IC's generally formed on a silicon wafer.

FIG. 32 is a diamond blade of a dicing machine for the IC's generally formed on the silicon wafer, and a flange unit for fixing such diamond blade.

In the present embodiment, in cutting the ceiling substrate 560 and the element substrate 550, there was employed the diamond blade of the dicing machine generally utilized for semiconductor manufacture.

Referring to FIG. 32, a diamond blade 501 (thickness 0.05 mm, diamond particle size 2 to 3 $\mu$m), in installation on the dicing machine, is sandwiched between a rear flange 502 (at the machine side Y) and a front flange 503 (at the operator side X) on a spindle shaft 505, and is fixed by tightening with a flange nut 504.

If the flange nut is tightened with a torque of 5 kgf·cm or higher, and in particular with a torque of 10 kgf·cm or higher, the diamond blade 501 tends to be inclined toward the operator side because of a small deformation of the end of the flange. In ordinary situation, the tightening torque is maintained at 5 kgf·cm or less in order to avoid such inclination, but, in the present embodiment, the tightening torque was selected as 12 kgf·cm to cause an inclination of about 10 $\mu$m, in order to positively form an inclined cut face.

The diamond blade 501 thus fixed was used in dicing the element substrate 550 (or ceiling substrate 560) formed on a silicon wafer of 6 inches, thereby obtaining the individual substrate.

Such dicing operation resulted in an inclination of 5 to 15 $\mu$m on the silicon wafer of the thickness of 0.625 mm.

In mounting the diamond blade on the dicing machine, the direction of inclination of the diamond blade is naturally aligned with the direction of the wafer, bearing a plurality of the element substrates 550 (or the ceiling substrates 560), in such a manner that the ridges, within the adhesion face 544 of the substrate 550 or 560 with the orifice plate, protrude more on the mutual adjoining faces of the substrates 550, 560 than the ridges on the opposite faces.

The element substrate 550 and the ceiling substrate 560, separated by the above-described cutting operation, are aligned by mutual abutting of the ridges at the adhesion face with the orifice plate, and are adjoined in such a manner that the energy generating element 551 is positioned in the groove constituting the liquid path 561. It is thus rendered possible to achieve stable adjoining, without step difference or recess, as shown in FIGS. 33A to 33C, in the liquid path portion corresponding to the orifice of the orifice plate and with a step difference of ±2 $\mu$m (negative or positive sign respectively indicates that the ceiling substrate protrudes or is retracted from the element substrate) in a head of a width of 7 to 30 mm in the direction of array of the liquid paths, and also to achieve stable adjoining of the orifice plate in the next step.

The orifice 541 is formed on the orifice plate 540 with the KrF excimer laser beam of a wavelength of 248 nm, utilizing the apparatus shown in FIG. 9.

In the following there will be explained steps for preparing the liquid discharge head of the present embodiment, with reference to FIGS. 34A to 34D.

Figure 33A:
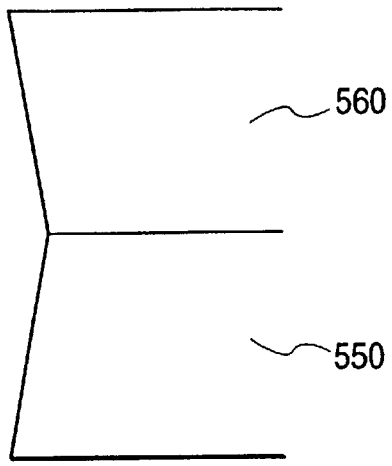
FIGS. 33A, 33B and 33C are views comparing examples of the adhesion face, to be adhered to the orifice plate, of the head main body prepared by the method according to the twelfth embodiment of the present invention.
Figure 33B:
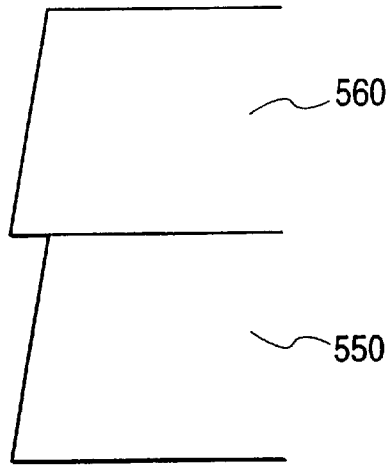
Figure 33C:
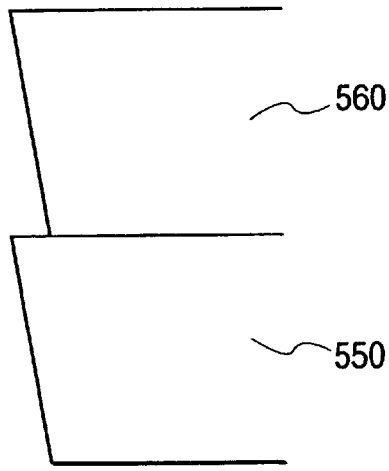

At first, on the orifice plate 540, a recess 547 is formed with a depth of 10 $\mu$m in such a manner that protruding portions 545 are linearly arranged in plural units at a pitch of 600 dpi and have dimension of 30×30 $\mu$m, and that grooves 543 are formed at a position of 30 $\mu$m from the protruding portion 545, with a width of 20 $\mu$m and a depth of 20 $\mu$m from the bottom of the recess 547, thereby forming the recess 547 and the groove 543 constituting the adhesion face with the head main body (FIGS. 33A, 33B).

Figures 1, 34A:
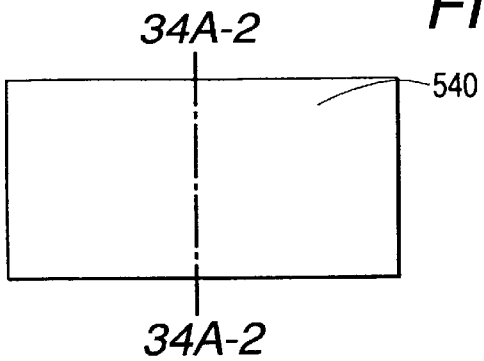
Figures 2, 34A:
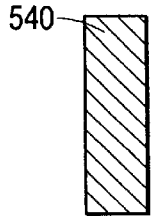
Figures 1, 34B:
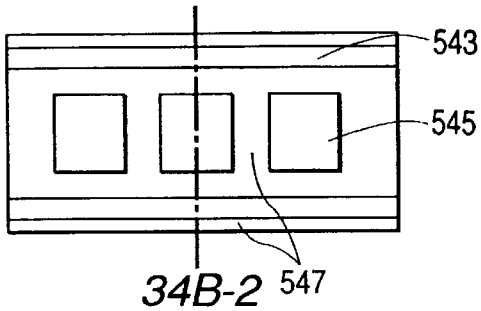
Figures 2, 34B:
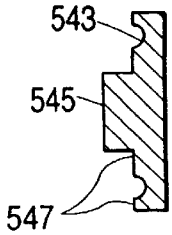
Figures 1, 34C:
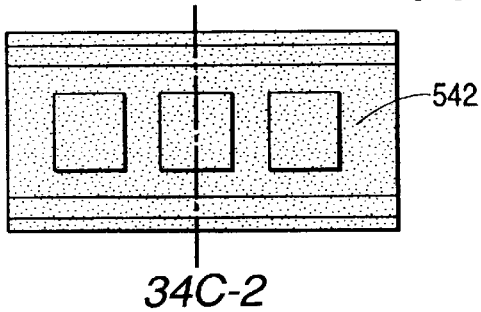
Figures 2, 34C:
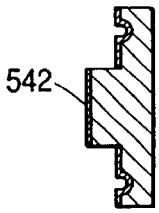

Then an epoxy adhesive 542, which is shifted to the B-stage to complete shrinkage by UV irradiation while maintaining the tackiness and which can thereafter be adhered by heating and pressing, is uniformly sprayed on the adhesion face of the orifice plate 540 with the head main body. Then the adhesive material is shifted to the B-stage with shrinkage, by ultraviolet irradiation of 1 mW/cm$^2$ for 60 seconds (FIG. 34C). In the present embodiment, the adhesive 542 may also be applied, as shown in FIG. 31, to the adhesion face of the head main body, constituted by the ceiling substrate 560 and the element substrate 550, to be adhered with the orifice plate 540.

Figures 1, 34D:
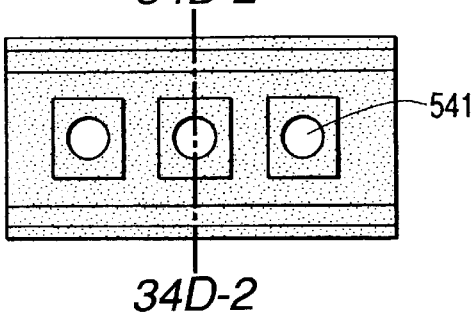
Figures 2, 34D:
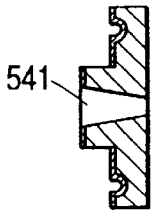

Then the excimer laser beam was irradiated from the side of the adhesion face of the orifice plate with the main body of the head to form an orifice of a diameter of 20 $\mu$m in each protruding portion (FIG. 34D). Subsequently the protruding portion 545, provided around the orifice 541, is inserted into the liquid path 561 of the head main body obtained by adjoining the element substrate 550 and the ceiling substrate 560, and the two members are adjoined at the recess 547.

Subsequently a pressure of 1 kg/cm$^2$ is applied on the orifice face to maintain the orifice plate 540 and the head main body in close contact, and heating is conducted at 60° C. in such pressed state to complete the hardening of the adhesive.

The liquid discharge head after the adhesive hardening provided satisfactory printing without streaks or unevenness therein and without the peeling of the orifice plate 540. Also the adhesion state of the main body of the head and the orifice plate, observed across the orifice plate proved absence of bubble inclusion on the adhesion face around the orifice. Also the liquid discharge head, disassembled and observed, proved absence of undesirable substances in the orifice and in the liquid path.

[Variation]

FIGS. 35A to 35D are schematic views showing a method of forming the adhesion face for the orifice plate, simultaneously at the time of cutting of the adjoined member, formed by adjoining the silicon wafer bearing a plurality of the element substrates 550 and a silicon wafer bearing a plurality of the ceiling substrates 560.

If a diamond blade of a thickness not exceeding 0.1 mm in dicing the adjoined member formed by adjoining two silicon wafers of a standard thickness (0.625 mm), the diamond blade has to protrude by at least 1.3 mm from the flanges, thus showing insufficient rigidity or a significant inclination in the course of the dicing operation, whereby the blade is eventually broken or the working speed is limited. On the other hand, if the thickness of the diamond blade is increased in order to elevate the rigidity (0.2 mm or larger), the dicing streets on the wafer becomes wider to reduce the number of elements per wafer, thereby leading to an increase in the cost. There are also encountered drawbacks such as the smear of the element by the cut powder because of the increased amount of cutting and the protrusion of the lower end of the cut face of the wafer, resulting from the abrasion of the periphery of the diamond blade. Also the U.S. Pat. No. 5,057,853 discloses, in separating the above-mentioned adjoined member into the individual head main body by the dicing operation, a method of using the dicing blade in two steps on the adjoined member, by cutting about one and a half wafers within the two wafers constituting the adjoined member in a first cutting operation, and cutting the remainder of such cutting operation in a second cutting operation. This method also results in the aforementioned drawbacks in case the thickness of the dicing blade is same as explained above.

The present embodiment provides a producing method capable of resolving the above-mentioned drawbacks, and such producing method will be explained with reference to FIGS. 35A to 35D.

Figure 35A:
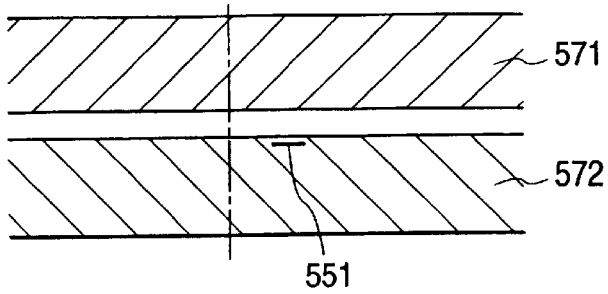
FIGS. 35A, 35B, 35C and 35D are schematic cross-sectional views showing steps for forming the liquid discharge head in a variation of the twelfth embodiment of the present Invention.
Figure 35B:
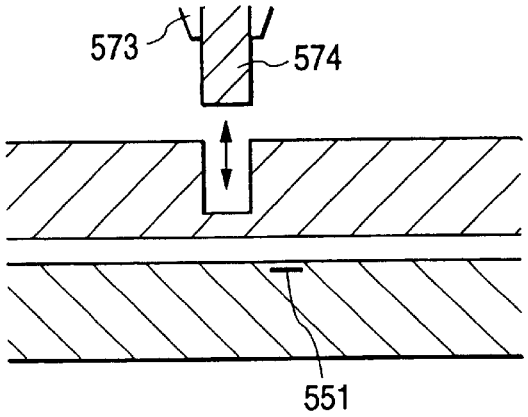

At first, in the adjoined member shown in FIG. 35A, a groove is formed to a position of 50~100 $\mu$m above the liquid path in the wafer 71 constituting the ceiling substrates, by means of a diamond blade 573 which is larger in width than the diamond blade 576 to be used for finally forming the adhesion face for the orifice plate (FIG. 35B). The diamond blade employed has a thickness of 0.1 mm.

Figure 35C:
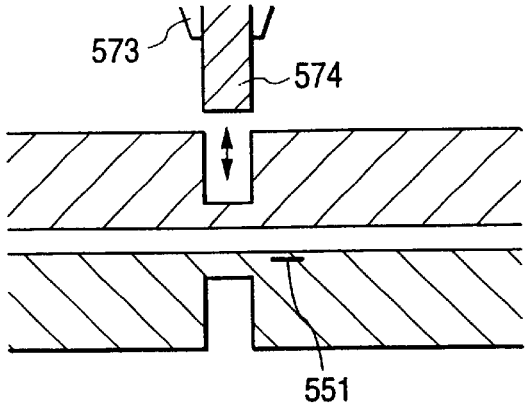
Figure 35D:
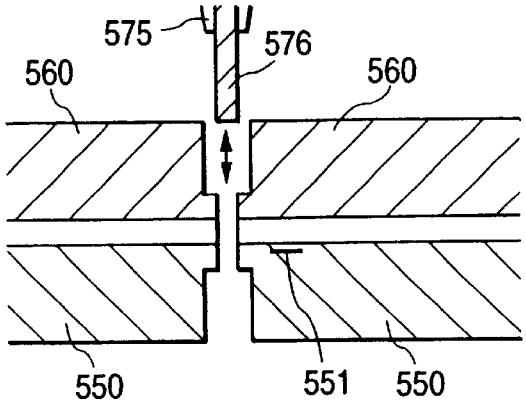

Then the adjoined member is inverted, and a groove is formed with the diamond blade of a same width as explained above, from the back surface of the wafer 572 constituting the ceiling substrate to a position of 50~100 $\mu$m above the element bearing surface (FIG. 35C)

Then the adjoined member is inverted again, and a diamond blade 576 of a thickness of 0.07 mm to be used for forming the adhesion face to the orifice plate is used for cutting the adhesion face of the orifice plate and a perpendicular dicing line (not shown) to obtain the individual head main body. In such method, the adhesion face of the head main body, to be adhered to the orifice plate, can be formed without step difference and perpendicularly to the substrates constituting the head main body.

Thereafter the liquid discharge head is completed by adjoining the orifice plate, prepared in a similar manner as in the twelfth embodiment, to the adhesion face of the head main body. In such producing method, the adhesion face of the head main body to be adhered to the orifice plate is free from any step difference, so that the crosstalk cannot occur between the neighboring nozzles after the adjoining of the orifice plate. Also the amount of cutting of the wafer by the dicing blade is limited, so that a thinner dicing blade can be employed with improved productivity.

In the present embodiment, the groove is formed at first on the ceiling substrate, but it is also possible to form the groove at first on the element substrate.

In the following there will be explained a head cartridge and a liquid discharge recording apparatus utilizing the liquid discharge head described in the foregoing.

Figure 36:
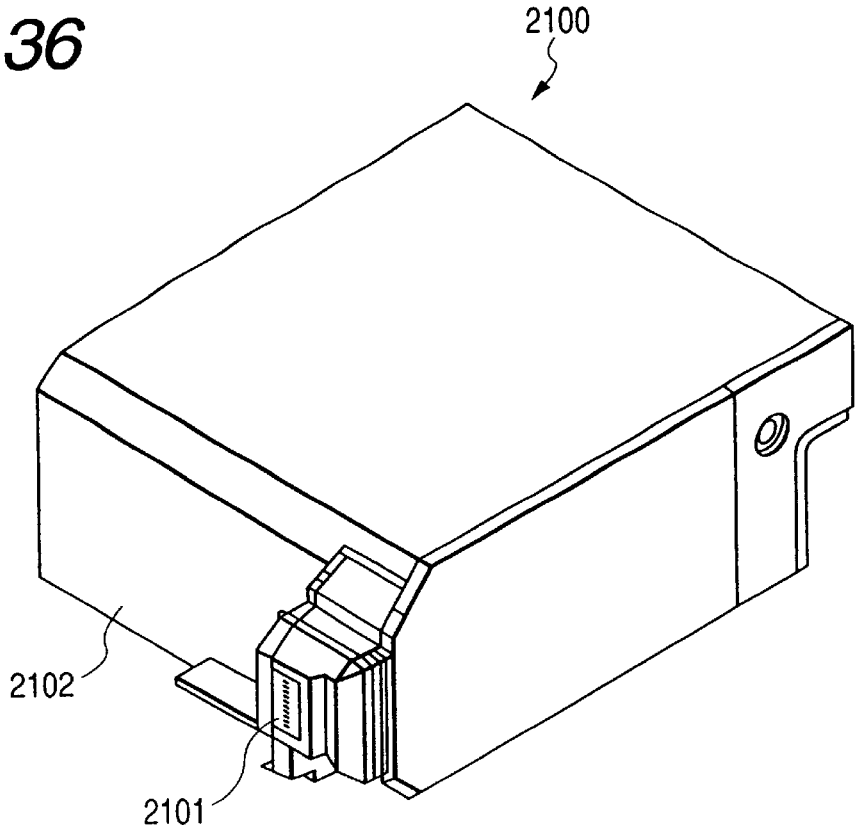
FIG. 36 is a perspective view showing an example of the head cartridge utilizing the liquid discharge head of the present invention.

FIG. 36 is a perspective view of a head cartridge utilizing the liquid discharge head of the present invention. The head cartridge 2100 integrally includes a liquid discharge head 2101 according to any of the foregoing embodiments, and an ink container 2102 for containing the ink to be supplied to the liquid discharge head 2101. The ink container 2102 may be re-used by ink refilling after the ink is consumed.

Figure 37:
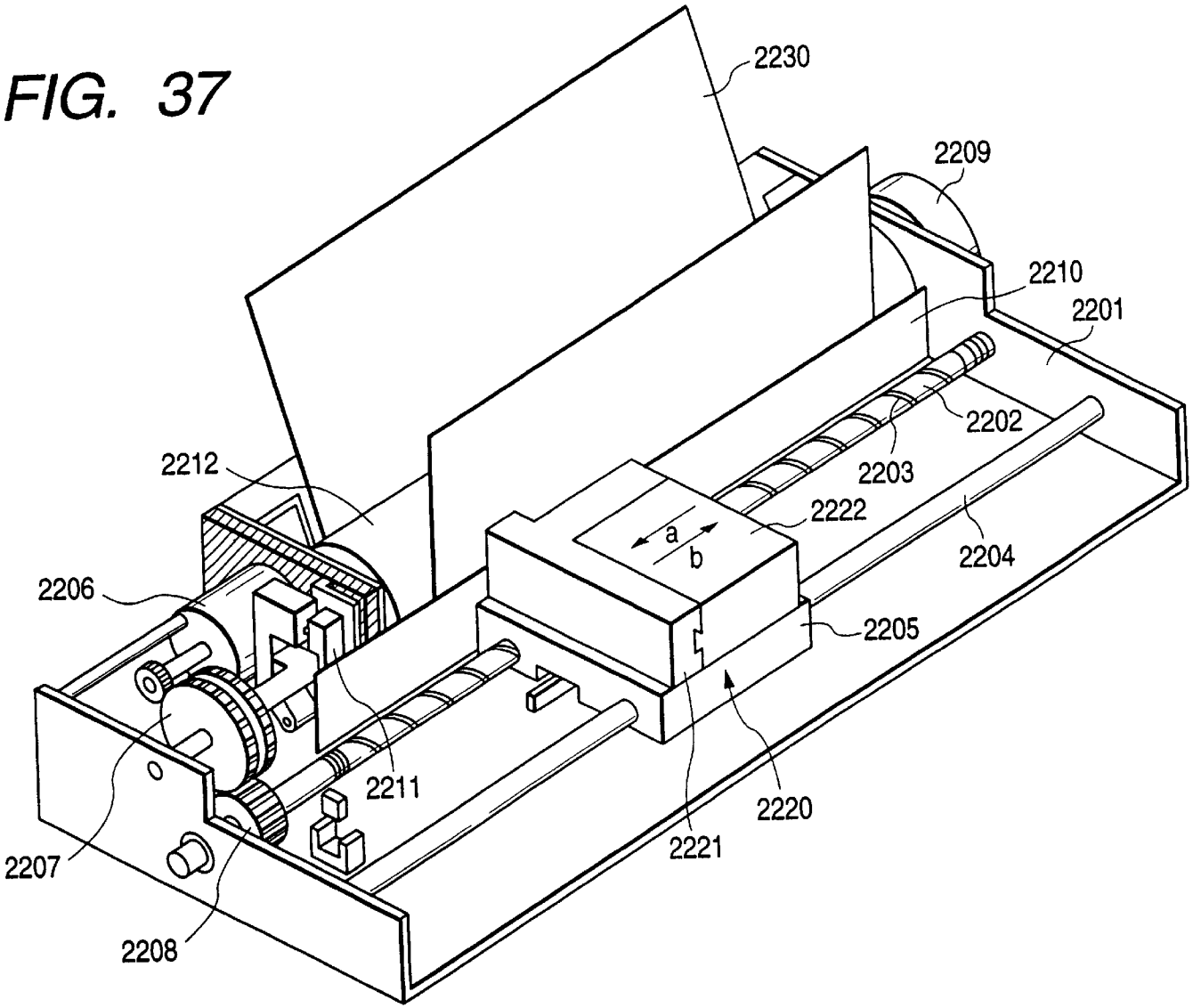
FIG. 37 is a schematic perspective view of a liquid discharge recording apparatus of serial type utilizing the liquid discharge head of the present invention.
Figure 39:
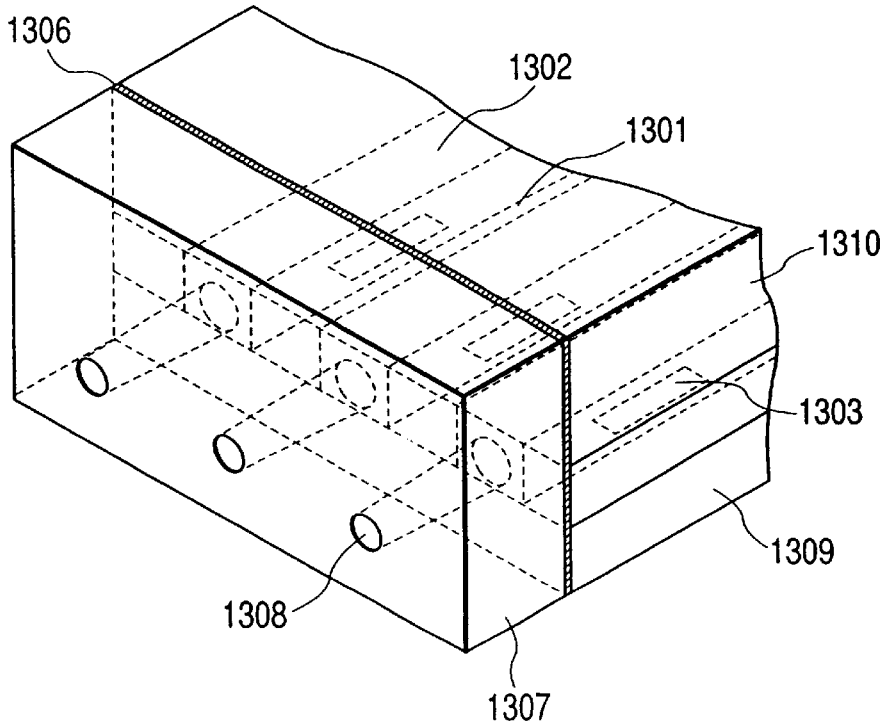
FIGS. 39 and 40 are perspective views of conventional liquid discharge heads.
Figure 40:
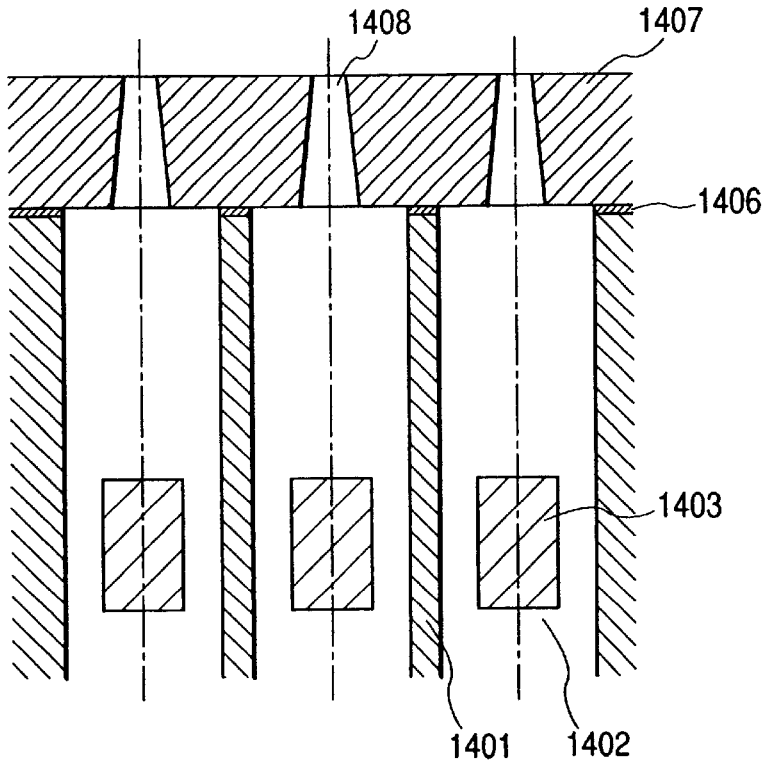

FIG. 37 is a schematic perspective view of a liquid discharge recording apparatus of serial type, utilizing the liquid discharge head of the present invention. As shown in FIG. 37, a frame 2201 rotatably supports a lead screw 2202 having a spiral groove 2203 and a guide shaft 2205 parallel to the lead screw 2202. A carriage 2205 engages with the spiral groove 2203 by an unrepresented pin and slidably guided b the guide shaft 2204, and the forward or reverse rotation of a motor 2206 is transmitted to the lead screw 2202 through gears 2207, 2208 whereby the carriage 2205 is reciprocated in the directions a and b.

The carriage 2205 detachably supports a head cartridge 2220 that can be separated into a head unit 2221 including the liquid discharge head of the foregoing embodiments, and an ink container 2222 for ink supply to the liquid discharge head. The head cartridge 2220 can also be of an integral type, as shown in FIGS. 8A to 8C, in which the liquid discharge head 2101 and the ink container 2102 are not separable.

A paper pressing plate 2210 presses the recording medium 2230 to a platen roller 2212 rotated by a paper feeding motor 2209 over the moving direction of the carriage 2205, and the recording medium 2230 is conveyed by the friction between the platen roller 2212 and the recording medium 2230 upon rotation of the platen roller 2212. Recording is executed on the recording medium 2230 by ink discharge from the liquid discharge head while the reciprocating motion of the carriage 2205 and the stepped advancement of the recording medium 2230 are repeated.

In a position opposed to the front face (surface of the orifice plate) of the liquid discharge head when the carriage 2205 is in a home position, there is provided a cap member 2211 for capping the front face of the liquid discharge head. The cap member 2211 is connected to suction means (not shown) which is activated when the front face of the liquid discharge head is capped to execute a suction recovery operation of forcedly sucking the undesirable substances or viscosified ink from the liquid discharge head, thereby maintaining the discharge characteristics thereof.

Figure 38:
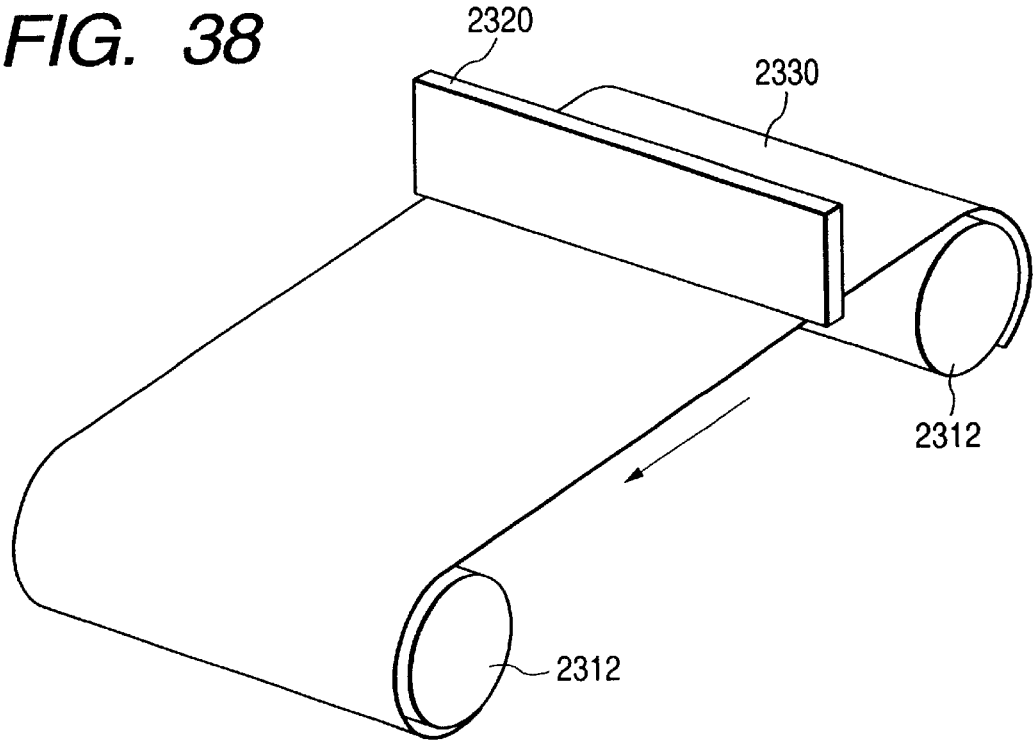
FIG. 38 is a schematic perspective view of a liquid discharge recording apparatus of full-line type utilizing the liquid discharge head of the present invention.

FIG. 38 is a schematic perspective view of a liquid discharge recording apparatus of full-line type employing the liquid discharge head of the present invention. In FIG. 38, the liquid discharge head 2320 is opposed to the recording medium 2330 conveying by two conveying rollers 2312. The liquid discharge head 2320 is structured similarly to the foregoing embodiments, and is provided with orifices over the entire width of the recording area of the recording medium 2330.

What is claimed is:

1. A liquid discharge head comprising:

an orifice plate having plural discharge openings for discharging a liquid droplet; and a head main body provided with plural liquid paths for respectively communicating with said plural discharge openings, a liquid chamber for liquid supply to said plural liquid paths, a supply aperture for liquid supply to said liquid chamber, and plural energy generating elements provided corresponding to said plural liquid paths and adapted to generate energy for discharging the liquid droplet, said liquid discharge head being formed by adjoining said orifice plate with an adhesion face of said head main body on which are formed apertures of said liquid paths for communicating with said discharge openings of said orifice plate, wherein said orifice plate comprises a recessed portion and a protruding portion on an adhesion face of said orifice plate, said protruding portion has a shape corresponding to a cross-sectional shape of said liquid path and is provided with one of said discharge openings therein, said protruding portion or a part thereof is made to enter and to fit with one of said liquid paths of said head main body, and said adhesion face of said orifice plate is adjoined with said adhesion face of said head main body, and wherein pitch A of arrangement of said liquid paths, width B of each of said liquid paths, width C of said protruding portion in a direction of the arrangement of said liquid paths, height D of each of said liquid paths, width E of said protruding portion in a direction perpendicular to the direction of the arrangement of said liquid paths, linear expansion coefficient a of said head main body, linear expansion coefficient b of said orifice plate, number n of said liquid paths, and environmental temperature difference At between a temperature before and a temperature after the adjoining of said head main body and said orifice plate satisfy the following two conditions:

$$(B-C)/2 \geqq |(a-b)\times n\times A\times \Delta t|,$$

and $$(D-E)/2 \geqq |(a-b)\times D\times \Delta t|.$$

2. A liquid discharge head according to claim 1, wherein said orifice plate is subjected at a surface thereof to water-repelling treatment.

3. A liquid discharge head according to claim 1, wherein said protruding portion has a tapered shape a diameter of which decreases in a discharging direction of the liquid droplet.

4. A liquid discharge head comprising:

an orifice plate having plural discharge openings for discharging a liquid droplet; and a head main body provided with plural liquid paths for respectively communicating with said plural discharge openings, a liquid chamber for liquid supply to said plural liquid paths, a supply aperture for liquid supply to said liquid chamber, and plural energy generating elements provided corresponding to said plural liquid paths and adapted to generate energy for discharging the liquid droplet, said liquid discharge head being formed by adjoining said orifice plate with an adhesion face of said head main body on which are formed apertures of said liquid paths for communicating with said discharge openings of said orifice plate, wherein said orifice plate comprises a recessed portion and a protruding portion on an adhesion face of said orifice plate, said protruding portion has a shape corresponding to a cross-sectional shape of said liquid path and is provided with one of said discharge openings therein, said protruding portion or a part thereof is made to enter and to fit with one of said liquid paths of said head main body, and said adhesion face of said orifice plate is adjoined with said adhesion face of said head main body, and wherein, on said adhesion face of said head main body, a portion of said liquid path protrudes more than other portions and is adjoined with said adhesion face of said orifice plate.

* * * * *

UNITED STATES PATENT AND TRADEMARK OFFICE

CERTIFICATE OF CORRECTION

PATENT NO. : 6,527,377 B1
DATED : March 4, 2003
INVENTOR(S) : Ken Ikegame et al.

It is certified that error appears in the above-identified patent and that said Letters Patent is hereby corrected as shown below:

Column 1,
Line 64, “(neighboring” should read -- neighboring --.

Column 2,
Line 38, “following-method.” should read -- following method --.

Column 3,
Line 14, “With” should read -- with --.

Column 6,
Line 14, “Invention;” should read -- invention; --; and
Line 24, “invention,” should read -- invention; --.

Column 7,
Line 23, “Cross” should read -- cross- --.

Column 10,
Line 30, “by products” should read -- by-products --.

Column 15,
Line 53, “body,” should read -- body; --.

Column 16,
Line 9, “of he” should read -- of the --; and
Line 56, “Ink” should read -- ink --.

Column 18,
Line 9, “20D” should read -- 20B --.

Column 22,
Line 24, “method,” should read -- methods, --.

UNITED STATES PATENT AND TRADEMARK OFFICE

CERTIFICATE OF CORRECTION

PATENT NO. : 6,527,377 B1
DATED : March 4, 2003
INVENTOR(S) : Ken Ikegame et al.

It is certified that error appears in the above-identified patent and that said Letters Patent is hereby corrected as shown below:

Column 29,
Line 33, "cross sectional" should read -- cross-sectional --.

Column 34,
Line 7, "At" should read -- $\Delta t$ --.

Signed and Sealed this

Fourteenth Day of October, 2003

JAMES E. ROGAN
*Director of the United States Patent and Trademark Office*